US006470597B1

(12) United States Patent
Stipp

(10) Patent No.: US 6,470,597 B1
(45) **Date of Patent: *Oct. 29, 2002**

(54) PROCESS AND APPARATUS FOR REMOVING WATER FROM MATERIALS USING OSCILLATORY FLOW-REVERSING GASEOUS MEDIA

(75) Inventor: Gordon Keith Stipp, Cincinnati, OH (US)

(73) Assignee: Institute of Paper Science and Technology, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/564,122

(22) Filed: May 3, 2000

Related U.S. Application Data

(63) Continuation-in-part of application No. 09/108,844, filed on Jul. 1, 1998, and a continuation-in-part of application No. 09/108,847, filed on Jul. 1, 1998, now Pat. No. 6,085,437.

(51) Int. Cl.[7] ..... F26B 7/00

(52) U.S. Cl. ..... 34/422; 34/444; 34/486; 34/488

(58) Field of Search ..... 34/422, 444, 486, 34/488, 245, 402, 414, 489; 162/206, 207, 359.1, 290, 375; 347/12, 13, 33, 44, 55; 28/103, 104, 105, 106; 431/1

(56) References Cited

U.S. PATENT DOCUMENTS 6,210,149 B1 4/2001 Plavnik et al.

6,308,436 B1 * 10/2001 Stipp ..... 34/422

* cited by examiner

*Primary Examiner*—Denise L. Esquivel
*Assistant Examiner*—Melvin Jones
(74) *Attorney, Agent, or Firm*—Vladimir Vitenberg

(57) ABSTRACT

A process and an apparatus for removing water from a material are disclosed. The material can be selected from the group consisting of fibrous webs, textiles, plastics, non-woven webs, building materials, or any combination thereof, and may comprise an agricultural product, a food product, a pharmaceutical product, a biotechnology product, etc.

The process comprises providing a material; providing an oscillatory flow-reversing impingement gaseous media having predetermined frequency; providing a gas-distributing system designed to emit the oscillatory flow-reversing impingement gas onto the material; and impinging the oscillatory flow-reversing gas onto the material, thereby removing moisture from the material.

The apparatus comprises a support to receive the material and to carry said material in a machine direction; a pulse generator producing oscillatory flow-reversing air or gas; and a gas-distributing system in fluid communication with the pulse generator for delivering the oscillatory flow-reversing gas to the material, wherein the gas-distributing system terminates with at least one discharge outlet juxtaposed with the support.

32 Claims, 13 Drawing Sheets

PROCESS AND APPARATUS FOR REMOVING WATER FROM MATERIALS USING OSCILLATORY FLOW-REVERSING GASEOUS MEDIA

This Application is Continuation-in-Part of Ser. Nos. 09/108,844 and 09/108,847 now U.S. Pat. No. 6,085,437 both filed on Jul. 1, 1998.

FIELD OF THE INVENTION

The present invention is related to processes for dewatering and/or drying a variety of materials. More particularly, the present invention is concerned with dewatering and/or drying of various material using oscillatory flow-reversing gaseous media.

BACKGROUND OF THE INVENTION

Pulse combustion technology is a known and viable commercial method of enhancing heat and mass transfer in thermal processes. Commercial applications include industrial and home heating systems, boilers, coal gassification, spray drying, and hazardous waste incineration. For example, the following U.S. Patents disclose several industrial applications of pulse combustion: U.S. Pat. No. 5,059,404, issued Oct. 22, 1991 to Mansour et al.; U.S. Pat. No. 5,133,297, issued Jul. 28, 1992 to Mansour; U.S. Pat. No. 5,197,399, issued Mar. 30, 1993 to Mansour; U.S. Pat. No. 5,205,728, issued Apr. 27, 1993 to Mansour; U.S. Pat. No. 5,211,704, issued May 18, 1993 to Mansour; U.S. Pat. No. 5,255,634, issued Oct. 26, 1993 to Mansour; U.S. Pat. No. 5,306,481, issued Apr. 26, 1994 to Mansour et al.; U.S. Pat. No. 5,353,721, issued Oct. 11, 1994 to Mansour et al.; and U.S. Pat. No. 5,366,371, issued Nov. 22, 1994 to Mansour et al., the disclosures of which patents are incorporated by reference herein for the purpose of describing pulse combustion. An article entitled "Pulse Combustion: Impinging Jet Heat Transfer Enhancement" by P. A. Eibeck et al, and published in *Combustion Science and Technology,* 1993, Vol. 94, pp. 147–165, describes a method of convective heat transfer enhancement, involving the use of pulse combustor to generate a transient jet that impinges on a flat plate. The article reports enhancements in convective heat transfer of a factor of up to 2.5 compared to a steady-flow impingement.

It is believed that the oscillatory flow-reversing impingement can also provide significant increase in heat and mass transfer in a variety of dewatering and/or drying processes. In particular, it is believed that the oscillatory flow-reversing impingement can provide significant benefits with respect to increasing machine rates in processes using moving conveyer belts for supporting the material being dewatered or dried. In addition, it is believed that the oscillatory flow-reversing impingement may enable one to achieve a substantially uniform drying of the differential-density materials or materials having a non-uniform thickness. It is now also believed that the oscillatory flow-reversing impingement may be successfully applied to dewatering and/or drying of materials, alone or in combination with other water-removing processes, such as through-air drying, steady-flow impingement drying, infra red drying, microwave drying, and drying-cylinder drying where applicable.

Examples of the materials that could be subjected to the impingement flow-reversing drying/dewatering in accordance with the present invention include, without limitation: papers, textiles, plastics, agricultural and food products, biotechnology products, pharmaceutical products, and building materials. The suitable materials may be in either continuous form (for example: plastic, webs), or discontinuous form (for example: sand, granular materials, pellets).

Accordingly, the present invention provides a process and an apparatus for removing water or other liquids from a variety of materials, using the oscillatory flow-reversing impingement gas. The present invention also provides an apparatus comprising a gas-distributing system allowing one to effectively control the distribution of the oscillatory flow-reversing gaseous media (such as air or gas) throughout the surface of the material being dewatered or dried. The present invention provide a gas-distributing system that creates a controlled application (for example, a substantially uniform application) of the oscillatory flow-reversing air or gas onto the material being dewatered or dried.

SUMMARY OF THE INVENTION

The present invention provides a novel process and an apparatus for removing water or other liquids from a variety of materials, such as, for example, papers, textiles, plastics, agricultural, biotechnology, food products, pharmaceutical products, and building materials, by using oscillatory flow-reversing air or gas as an impinging medium. The material to be dewatered may have a starting moisture content in a broad range, from about 1% to about 99%.

In its process aspect, the present invention comprises the following steps: providing a material to be dewatered or dried; providing an oscillatory flow-reversing impingement gaseous media (gas or air, or any combination thereof) having a predetermined frequency; providing a gas-distributing system terminating with at least one discharge outlet and designed to deliver the oscillatory flow-reversing impingement gaseous media onto a predetermined portion of the material to be dewatered; and impinging the oscillatory flow-reversing gaseous media onto the material through the gas-distributing system, thereby removing moisture from the material. The oscillatory flow-reversing gaseous media may beneficially be impinged onto the material to be dewatered or dried in a predetermined pattern defining an impingement area of the material.

A water-removing apparatus of the present invention has a machine direction and a cross-machine direction perpendicular to the machine direction. The apparatus of the present invention comprises: a support designed to receive thereon a material to be dewatered or dried and to carry it in the machine direction; at least one pulse generator designed to produce oscillatory flow-reversing air or gas; and at least one gas-distributing system in fluid communication with the pulse generator for delivering the oscillatory flow-reversing air or gas to a predetermined portion of the material to be dewatered or dried. The gas-distributing system terminates with at least one discharge outlet juxtaposed with the support (or with the material when the material is disposed on the support). The support and the at least one discharge outlet form an impingement region therebetween. The impingement region is defined by an impingement distance "Z" formed between the at least one discharge outlet and the support. In the embodiments of the apparatus comprising a plurality of discharge outlets, the discharge outlets are disposed such as to form a predetermined pattern defining an impingement area "E." The oscillatory flow-reversing gas may be impinged onto the material to provide a substantially even distribution of the gas throughout the impingement area. Alternatively, the oscillatory gas may be impinged onto the material to provide an uneven distribution of the gas throughout the impingement area, thereby allowing control of moisture profiles throughout the surface of the material to be dewatered or dried.

According to the present invention, the pulse generator is a device which is designed to produce oscillatory flow-reversing air or gas having a cyclical velocity/momentum component and a mean velocity/momentum component. A cyclical pressure generated by the pulse generator is converted to a cyclical movement/velocity of large amplitude, comprising negative cycles alternating with positive cycles, the positive cycles having greater momentum and cyclical velocity relative to the negative cycles.

In one embodiment, the pulse generator comprises a pulse combustor, generally comprising a combustion chamber, an air inlet, a fuel inlet, and a resonance tube. The tube operates as a resonator generating standing acoustic waves. The resonance tube is in further fluid communication with a gas-distributing system. As used herein, the term "gas-distributing system" defines a combination of tubes, tailpipes, blow boxes, etc., designed to provide an enclosed path for the oscillatory flow-reversing air or gas produced by the pulse generator, and to deliver the oscillatory flow-reversing air or gas to a pre-determined impingement region (defined herein above), where the oscillatory flow-reversing air or gas is impinged onto the material to be dewatered or dried, thereby removing water therefrom. The gas-distributing system is designed such as to minimize, and preferably avoid altogether, disruptive interference which may adversely affect a desired mode of operation of the pulse combustor or oscillatory characteristics of the flow-reversing gas generated by the pulse combustor. The gas-distributing system delivers the flow-reversing impingement air or gas onto the material to be dewatered or dried through at least one discharge outlet, or nozzle.

The frequency of the oscillatory flow-reversing impingement air or gas is in a range of from about 15 Hz to about 3,000 Hz, more specifically from about 15 Hz to about 1,500 Hz, still more specifically from 15 Hz to 1,000 Hz, and still more specifically from 15 Hz to 500 Hz, depending on a type of the pulse generator and/or desired characteristics of the water-removing process. If the pulse generator comprises the pulse combustor, the frequency may be chosen from about 15 Hz to about 500 Hz. If the pulse generator comprises a rotary valve pulse generator, the frequency may be chosen from about 15 Hz to about 1,500 Hz, more specifically from about 15 Hz to about 500 Hz, and still more specifically from about 15 Hz to about 250 Hz.

A Helmholtz-type resonator may beneficially be used in the pulse generator of the present invention. Typically, the Helmholtz-type pulse generator may be tuned to achieve a desired pulse frequency. In the pulse combustor, the temperature of the oscillatory gas at the exit from the discharge outlets is from about 500° F. to about 2500° F.

Another embodiment of the pulse generator comprises an infrasonic device. The infrasonic device comprises a resonance chamber in fluid communication with an air inlet through a pulsator. The pulsator generates an oscillating air having infrasound (low frequency) pressure which then is amplified in the resonance chamber and in the resonance tube. The infrasonic device's frequency of the oscillating flow-reversing air is from 15 Hz to 100 Hz. If desired, the apparatus comprising the infrasonic device may have a means for heating the oscillatory flow-reversing air generated by the infrasonic device. Other embodiments of the pulse generator include, without limitation, solenoid valves, fluidic valves, rotary valves, butterfly valves, vibrating mechanical elements, rotating lobes, slot jets, edge jets, and pizeo electric elements. For a rotary valve pulse generator, for example, a broad temperature range is from ambient to 2500° F.

The oscillatory flow-reversing impingement air or gas has two components: a mean component characterized by a mean velocity and a corresponding mean momentum; and an oscillatory, or cyclical, component characterized by a cyclical velocity and a corresponding cyclical momentum. The oscillatory cycles during which the combustion gas moves "forward" from the combustion chamber, and into, through, and from the gas-distributing system are positive cycles; and the oscillatory cycles during which a back-flow of the impingement gas occurs are negative cycles. An average amplitude of the positive cycles is a positive amplitude, and an average amplitude of the negative cycles is a negative amplitude. During the positive cycles, the impingement gas has a positive velocity directed in a positive direction towards the material to be dewatered or dried disposed on the support; and during the negative cycles, the impingement gas has a negative velocity directed in a negative direction. The positive direction is opposite to the negative direction, and the positive velocity is opposite to the negative velocity. The positive velocity component is greater than the negative velocity component, and the mean velocity has the positive direction.

The pulse combustor produces an intense acoustic pressure, typically in the order of 160–190 dB, inside the combustion chamber. This acoustic pressure reaches its maximum level in the combustion chamber. Due to the open end of the resonance tube, the acoustic pressure is reduced to atmospheric at the exit of the resonance tube. This drop in the acoustic pressure results in a progressive increase in cyclical velocity which reaches its maximum at the exit of the resonance tube. It is beneficial to have the Helmholtz-type pulse generator in which the acoustic pressure is minimal at the exit of the resonance tube—in order to achieve a maximal cyclical velocity in the exhaust flow of oscillatory impingement gases. The decreasing acoustic pressure beneficially reduces noise typically associated with sonically enhanced processes of the prior art.

At the exit of the gas-distributing system, the cyclical velocity, ranging from about 1,000 ft/min to about 50,000 ft/min, and more specifically from about 2,500 ft/min to about 50,000 ft/min, is calculated based on the measured acoustic pressure in the combustion chamber. The more specific cyclical velocity is from about 5,000 ft/min to about 50,000 ft/min. The mean velocity is from about 1,000 ft/min to about 25,000 ft/min, more specifically from about 2,500 ft/min to about 25,000 ft/min, and still more specifically from about 5,000 to about 25,000 ft/min.

In order to achieve the desired water-removal rates, the oscillatory flow-reversing impingement gas should preferably form an oscillatory "flow field" substantially uniformly contacting the material throughout its impingement area. One way of accomplishing it is to cause the flow of the oscillatory gas from the gas-distributing system be substantially equally split and impinged onto the surface of the material through a network of the discharge outlets. The apparatus of the present invention is designed to discharge the oscillatory flow-reversing impingement air or gas onto the material to be dewatered or dried according to a pre-determined, and preferably controllable, pattern. A pattern of distribution of the multiple discharge outlets may vary. One beneficial pattern of distribution comprises a non-random staggered array.

The discharge outlets of the gas-distributing system may have a variety of shapes, including but not limited to: a round shape, generally rectangular shape, an oblong slit-like shape, etc. Each of the discharge outlets has an open area "A" and an equivalent diameter "D." A resulting open area "ΣA" is a combined open area formed by all individual open areas of the discharge outlets together. An area of a portion of the material to be dewatered or dried impinged upon by the oscillatory flow-reversing impingement field at any moment of the continuous process is an impingement area "E."

In a continuous process of the present invention, the material to be dewatered or dried is supported by the support traveling in the machine direction. In one embodiment a means for controlling the impingement distance may be provided, such as, for example, conventional manual mechanisms, as well as automated devices, for causing the outlets of the gas-distributing system and the support to move relative to each other, thereby changing the impingement distance. Prophetically, the impingement distance may be automatically adjustable in response to a signal from a control device, measuring at least one of the parameters of the dewatering process or one of the parameters of the material being dewatered or dried. Depending on the nature of the material being dewatered and its qualities, including moisture content, the impingement distance may vary from about 0.25 inches to about 24.0 inches. The impingement distance defines an impingement region, i. e., the region between the discharge outlet(s) and the support. In one embodiment, a ratio of the impingement distance Z to the equivalent diameter D of the discharge outlet (i. e., Z/D) is from about 1.0 to about 10.0. A ratio of the resulting open area ΣA to the impingement area E (i. e., ΣA/E) may be from 0.002 to 1.000.

In one embodiment, the gas-distributing system comprises at least one blow box. The blow box comprises a bottom plate having the plurality of the discharge outlets therethrough. The blow box may have a substantially planar bottom plate. Alternatively, the bottom plate of the blow box may have a non-planar or curved shape, such as, for example, a convex shape, or a concave shape. In one embodiment of the blow box, a generally convex bottom plate is formed by a plurality of sections. In another embodiment, the blow box terminates with the plate having a prolong, slit-like slot extending in the cross-machine direction relative to the movement of the material to be dewatered or dried.

An angled application of the oscillating flow-reversing air or gas may be beneficially used in the present invention. Angles formed between the general surface of the support (or a surface of the impingement area E of the material being dewatered) and the positive directions of the oscillating streams of air or gas through the discharge outlet may range from almost 0 degree to 90 degrees. These angles may be oriented in the machine direction, in the cross-machine direction, and in the direction intermediate the machine direction and the cross-machine direction.

A plurality of the gas distributing systems may be used across the width of the material being dewatered. This arrangement allows a greater flexibility in controlling the conditions of the dewatering process across the width of the material being dewatered. For example, such arrangement allows one to control the impingement distance individually for differential cross-machine directional portions of the material being dewatered. If desired, the individual gas-distributing systems may be distributed throughout the surface of the support in a non-random, for example, staggered-array, pattern.

The oscillatory field of the flow-reversing impingement gas may beneficially be used in combination with a steady-flow (non-oscillatory) impingement gas impinged onto the material being dewatered. One embodiment comprises sequentially-alternating application of the oscillatory flow-reversing gas and the steady-flow gas. One of or both the oscillatory gas and the steady-flow gas can comprise jet streams having the angled position relative to the support.

The support may include a variety of structures, for example, papermaking band or belt, wire or screen, a drying cylinder, etc. In one embodiment shown herein, the support travels in the machine direction at a transport velocity.

Using the process and the apparatus of the present invention one can simultaneously remove moisture from differential density portions of the material being dewatered. The dewatering characteristics of the oscillatory flow-reversing process is dependent to a significantly lesser degree upon the differences in density of the material being dewatered. Therefore, the process of the present invention effectively decouples the water-removal characteristics of the dewatering process—most importantly water-removal rates—from the differences in the relative densities of the differential portions of the material being dewatered.

One of the applications of the process of the present invention is in combination with application of pressure generated by a vacuum source. The apparatus of the present invention may be beneficially used in combination with a vacuum apparatus, such as, for example, a vacuum pick-up shoe or a vacuum box, in which instance the support is preferably fluid-permeable. The vacuum apparatus can juxtaposed with the backside surface of the support, preferably in the area corresponding to the impingement region. The vacuum apparatus applies a vacuum pressure to the material being dewatered or dried, through the fluid-permeable support. In this instance, the oscillatory flow-reversing gas created by the pulse generator and the pressure created by the vacuum apparatus can beneficially work in cooperation, thereby significantly increasing the efficiency of the combined dewatering process.

Optionally, the apparatus of the present invention may have an auxiliary means for removing moisture from the impingement region, including the boundary layer. Such an auxiliary means may comprise a plurality of slots in fluid communication with an outside area having the atmospheric pressure. Alternatively or additionally, the auxiliary means may comprise a vacuum source, and at least one vacuum slot extending from the impingement region, and/or an area adjacent to the impingement region, to the vacuum source, thereby providing fluid communication therebetween.

The present invention is believed to provide high water-removal rates and low air flow requirements, that results in reduced capital costs. The present invention is also believed to enable a material to tolerate high temperatures due to pulsating flows and ensure a reduced thermal damage to the material being dewatered or dried.

DETAILED DESCRIPTION OF THE INVENTION

Figure 1:
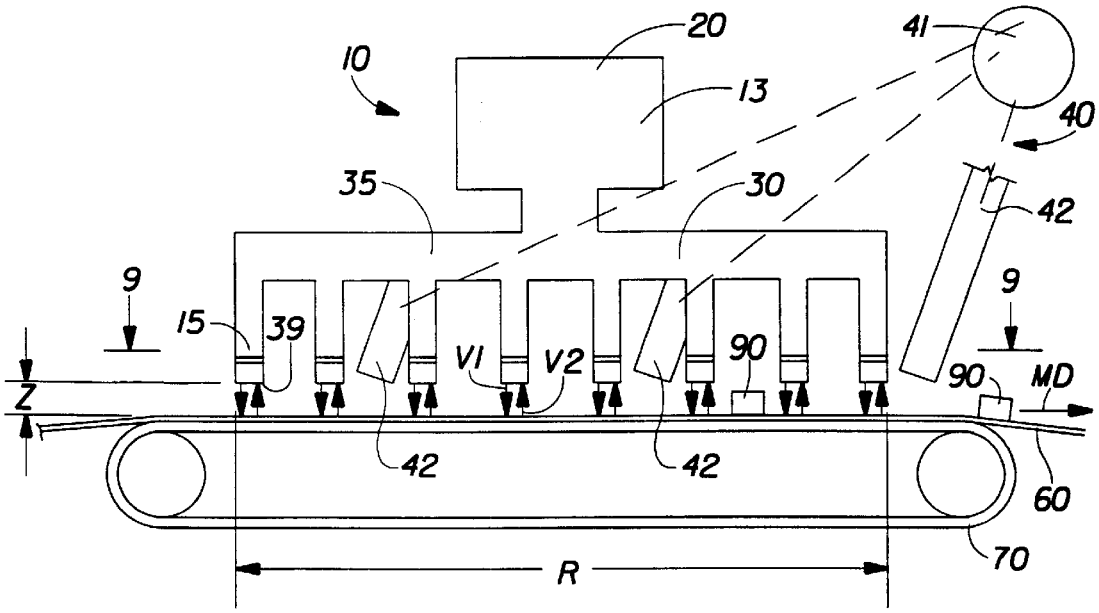
FIG. 1 is a schematic and simplified side elevational view of an apparatus and a continuous process of the present invention, showing a pulse generator emitting oscillatory flow-reversing impingement air or gas onto a moving material supported by an endless belt or band.

The first step of the process of the present invention comprises providing a material to be dewatered or dried. As used herein the term "material to be dewatered or dried," or simply "material" 60 (FIGS. 1 and 6–9) includes a variety of materials, such as, for example, papers, textiles, plastics, agricultural, pharmaceutical, food, biotechnology products, and building materials. The material 60 may comprise, without limitation, a solid substance (such as, for example, clothes, carpets, food products, and plastic items); granular substance (coffee, tablets); paste-like products (sludge, foamed extracts, extrudates); thin films (plastics, formed materials); and webs (non-woven, paper).

An apparatus 10 and the process of the present invention is believed to be useful for dewatering material 60 having a broad range of moisture content, from about 1% to about 99%.Of course, the parameters of the process and the apparatus 10 of the present invention should be adjusted to suit the specific needs depending on the material's moisture content before dewatering/drying and a desired moisture content after such dewatering/drying; a desired rate of dewatering/drying; transport velocity of the material 60; residence time (i. e., the time during which a certain portion of the material 60 is being acted upon by the flow-reversing impingement gas); and other relevant factors that will be discussed herein below. The material 60 may have a non-uniform moisture distribution prior to water removal by the process and the apparatus 10 of the present invention.

As used herein, the term "drying" means removal of water (or moisture) from the material 60 by vaporization. The vaporization involves a phase-change of the water from a liquid phase to a vapor phase, or steam. The term "dewatering" means removal of water from the material 60 without producing the phase-change in the water being removed. While these terms may be used herein interchangeably, this distinction between drying and dewatering is noted because, depending on a particular material 60 and its condition, one type of water removal may be more relevant than the other. For example, in an instance of the material 60 comprising a fibrous web, at the stage of a formation of an embryonic web, (FIG. 8, I and II), the bulk water is primarily removed by mechanical means. Thereafter, at stages of pressing and/or thermal operations and/or through-air-drying (FIG. 8, III and IV), vaporization is generally required to remove the water from the web.

As used herein, the terms "removal of water" or "water removal" (or permutations thereof) are generic and include both drying and dewatering, along or in combination. Analogously, the terms "water-removal rate(s)" or "rates of water removal" (and their permutations) refer to dewatering, drying, or any combination thereof. Similarly, the term "water-removing apparatus" applies to an apparatus of the present invention designed to remove water from the material 60 by drying, dewatering, or a combination thereof. A conjunctive-disjunctive combination "dewatering and/or drying" (or simply dewatering/drying) encompasses one of the following: dewatering, drying, or a combination of dewatering and drying, as defined herein.

The success of dewatering depends on the form of water present in the material 60, which, in turn, may be influenced by a structure of the material 60. Depending on the specific material 60 being dewatered, the water may be present in the material 60 in several distinct forms: bulk, micropore, colloidal-bound, and chemisorbed. (H. Muralidhara et al., *Drying Technology,* 3(4), 1985, 529–66. ) The bulk water can be removed via vacuum techniques. However, removal of the micropore water from the material 60 is more difficult than removal of the bulk water, because of the capillary forces formed between the material 60 and the water, that must be overcome. In the instance of papermaking, for example, both the colloidal-bound water and chemisorbed water cannot typically be removed from the web using conventional dewatering techniques, because of strong hydrogen bonding between the papermaking fibers and water, and must be removed by using thermal treatment. The apparatus and the process of the present invention is applicable to both the drying and the dewatering techniques of water-removal.

The apparatus 10 of the present invention comprises a pulse generator 20 in combination with a support 70 designed to carry the material 60 in the proximity of the pulse generator 20 such that the material 60 is penetrable by the flow-reversing impingement gas generated by the pulse generated 20. As used herein, the term "pulse generator" refers to a device which is structured and configured to produce oscillatory flow-reversing air or gas having a cyclical velocity/momentum component and a mean velocity/momentum component. Typically, an acoustic pressure generated by the pulse generator 20 is converted to a cyclical movement of large amplitude, comprising negative cycles alternating with positive cycles, the positive cycles having greater momentum and cyclical velocity relative to the negative cycles, as will be described in greater detail below.

Several types of devices can be used to generate the acoustic pressure used in the pulse generator of the present invention. These include, but are not limited to, devices that interrupt a gas flow or induce vibration in a gas flow. The oscillatory-pressure pulse in conjunction with a resonant chamber open on its discharge end produces a standing wave. The oscillatory-pressure pulse creates a wave that sets up the standing wave within the resonant tube. The wave pressure is then converted to an oscillatory flow-reversing flow field at the discharge end of the resonance tubes and/or distributors. Flow-interrupting devices include, without limitation, solenoid valves, rotary valves, fluidic valves, and rotating lobes. Vibration devices include vibrating mechanical elements, pizeo electric elements, slot jets, and edge-jets. The amplitude and frequency of the generated oscillatory-pressure wave can be modified by changing system geometry and/or operational parameters of the pulse generating device.

Designs of the devices, including flow-interrupting valves, suitable for use in the present invention include, but are not limited to, those disclosed in the following patents: U.S. Pat. No. 5,252,061 issued Oct. 12, 1993 to Ozer et al.; U.S. Pat. No. 4,708,159 issued Nov. 24, 1987 to Hanford Lockwood; U.S. Pat. No. 4,697,358 issued Oct. 6, 1987 to Kitchen; U.S. Pat. No. 3,650,295 issued Mar. 21, 1972 to Smith; U.S. Pat. No. 3,332,236 issued Jul. 25, 1967 to Kunsagi; U.S. Pat. No. 2,515,644 issued Jul. 18, 1950 to Goddard; U.S. Pat. No. 4,649,955 issued Mar. 17, 1987 to Otto et al.; U.S. Pat. No. 5,913,329 issued Jun. 22, 1999 to Hynes et al.; U.S. Pat. No. 4,834,288 issued May 30, 1989 to Kenny et al.; and U.S. Pat. No. 3,665,962 issued May 30, 1972 to Dornseiffen, the disclosures of which are incorporated herein by reference for the purpose of showing the suitable designs of pulse generators and flow interrupting devices.

In some embodiments, it may be beneficial to control the amplitude and the frequency of the pressure pulse independently from one another. This can be accomplished by altering a duty cycle defined as the ratio of valve-open time to valve-lose time, of the pulsed flow generator. A suitable design of such a valve is disclosed in U.S. Pat. No. 5,954,092, issued Sep. 21, 1999 to Joseph Kroutil et. al., the disclosure of which is incorporated herein be reference.

Vortices that are formed when the gas flows through an orifice or passes an edge cause periodic pressure changes that propagate through the gas as a pressure pulse. The frequency and quantity of vortices depends on the geometry of the device and gas velocity. The intensity of the pressure pulse can be increased by coupling a resonant cavity to the orifice or by placing a sharp edge at a fixed distance from the slit-shaped orifice. Descriptions of such devices are given in *Sonics—Techniques For The Use Of Sound And Ultrasound In Engineering And Science,* Chapter 7, pages 285–88, by T. Hueter and R. Bolt, 1955, John Wiley & Sons, Inc, New York, which publication is incorporated herein by reference. An example of a generator producing oscillating gas jets having frequency of about 100 Hz is described in U.S. Pat. No. 5,803,948 issued Sep. 8, 1998 to Anatoly Sizov et al., the disclosure of which is incorporated herein by reference. Coupling of such a device with a tuned resonator can produce the oscillatory flow-reversing flow suitable for use in some embodiments of the present invention.

Vibrator elements can produce the acoustic pressure needed in the pulse generator. These can comprise of either mechanical or pizeo-electric elements that vibrate at a controlled frequency. The vibration produces waves that, when in communication with a suitable tuned resonator, produce the oscillatory flow-reversing gaseous flow. In the instance of pizeo-electric devices, it may be beneficial to use multiple sound generators having different frequencies, as disclosed in Japanese patent JP54074414A issued Nov. 25, 1977 to Toshio, the disclosure of which is incorporated herein by reference.

Figure 4:
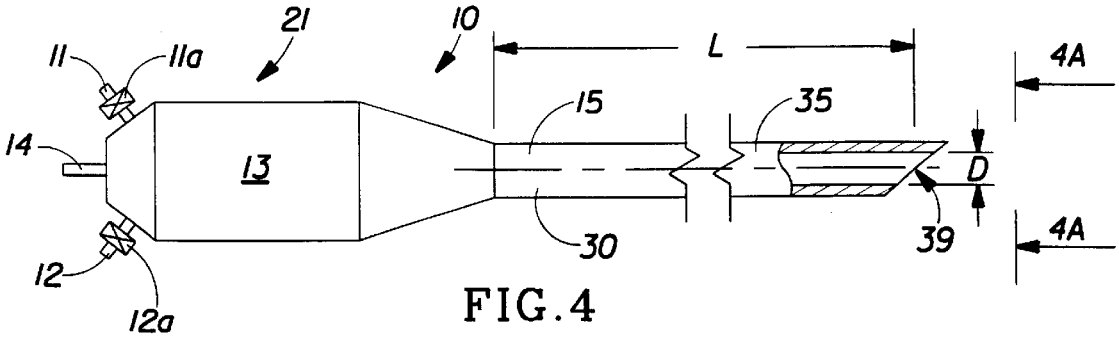
FIG. 4 is a schematic and simplified side elevational view of a pulse combustor which can be used in the apparatus and the process of the present invention.

One type of the pulse generator 20 that may be useful in the present invention comprises a sound generator and a tube, or tailpipe, of a substantially uniform diameter and having one end open to atmosphere and the other, opposite, end closed, a length L of the tube being measured between the tube's opposite ends (FIG. 4). The tube operates as a resonator generating standing acoustic waves. As well known in the art, the standing acoustic waves have an antinode (maximum velocity and minimum pressure) at the open end of the tube, and a node (minimum velocity and maximum pressure) at the closed end of the tube. Preferably, these standing waves satisfy the following condition: $L=\omega(2N+1)/4$, where L is the length of the tube; $\omega$ is the wavelength of the standing wave, and N is an integer (i. e., N=0,1,2,3, . . . , etc.).

A sound having wave length of one-forth of the resonator tube (i. e., $L=\omega/4$, and N=0) is typically defined in the art as a fundamental tone. Other sound waves are defined as a first harmonic (N=1), a second harmonic (N=2), a third harmonic (N=3), . . . , etc. In the present invention, it is beneficial to have the resonator tube having a length that equals to one fourth (¼) of the frequency generated by the sound generator, i. e., the pulse generator 20 that generates acoustic waves of the fundamental tone, with N=0. The standing acoustic waves provide a varying air pressure in the resonator tailpipe with the largest pressure amplitude at the closed end of the tailpipe resonator. Sound frequency and wavelength are related according to the following equation: $F=C/\omega$, where F is the sound frequency, and C is the speed of sound. In the instance of the pulse generator 20 generating the fundamental tone, the relationship between frequency and wavelength can be described more specifically by the formula: $F=C/4L$, from the previously defined relations.

FIG. 4 shows one embodiment of the pulse generator 20 comprising a pulse combustor 21. The pulse combustor 21 comprises a combustion chamber 13, an air inlet 11, a fuel inlet 12, and a resonance tube 15. As used herein, the term "resonance tube" 15 designates a portion of the pulse generator 20, which causes the combustion gases to longitudinally vibrate at a certain frequency while moving in a certain pre-determined direction defined by geometry of the resonance tube 15. One skilled in the art will appreciate that resonance occurs when a frequency of a force applied to the resonance tube 15, i.e. the frequency of the combustion gas created in the combustion chamber 13, is equal to or close to the natural frequency of the resonance tube 15. To put it differently, the pulse generator 20, including the resonance tube 15, is designed such that the resonance tube 15 transforms the hot combustion gas produced in the combustion chamber 13 into oscillatory (i. e., vibrating) flow-reversing impingement gas.

In FIG. 4, the air inlet 11 and the fuel inlet 12 are in fluid communication with the combustion chamber 13 for delivering air and fuel, respectively, into the combustion chamber 13, where the fuel and air mix to form a combustible mixture. Preferably, the pulse combustor 21 also includes a detonator 14 for detonating a mixture of air and fuel in the combustion chamber 13. The pulse combustor 21 may also comprise an inlet air valve 11*a* and an inlet fuel valve 12*a*, for controlling delivery of the air and the fuel, respectively, as well as parameters of combustion cycles of the pulse combustor 21.

Figure 9:
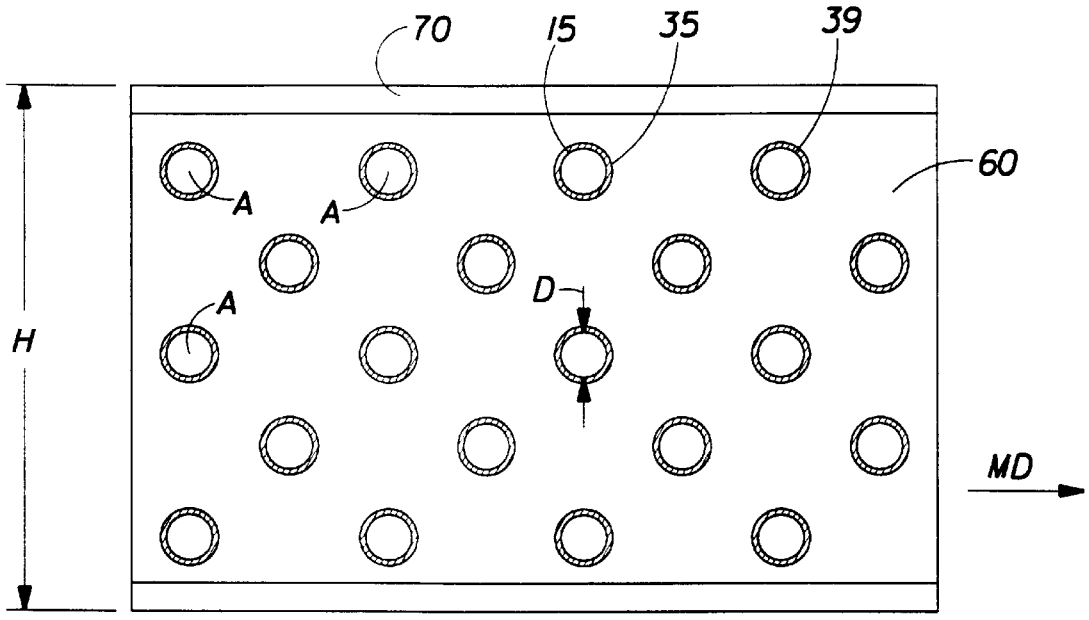
FIG. 9 is a schematic cross-sectional plan view taken along line 9—9 of FIG. 1, and showing one embodiment of a non-random pattern of the pulse generator's discharge outlets, relative to the surface of the material to be dewatered or dried.

The resonance tube 15 is in further fluid communication with a gas-distributing system 30. As used herein, the term "gas-distributing system" defines a combination of tubes, tailpipes, boxes, etc., designed to provide an enclosed path for the oscillatory flow-reversing air or gas produced by the pulse generator 20, and thereby deliver the oscillatory flow-reversing air or gas into a pre-determined impingement region, where the oscillatory flow-reversing air or gas is impinged onto the material 60, thereby removing water therefrom. The gas-distributing system 30 is designed such as to minimize, and preferably avoid altogether, disruptive interference which may adversely affect a desired mode of operation of the pulse combustor 21 or oscillatory characteristics of the flow-reversing gas generated by the pulse combustor 21. One skilled in the art will appreciate that at least in some possible embodiments (FIGS. 1, 9, and 4) of the apparatus 10 of the present invention, the gas-distributing system 30 may comprise the resonance tube or tubes 15. In other words, in some instances the resonance tube 15 may comprise an inherent part of both the pulse combustor 21 and the gas-distributing system 30, as they both are defined herein. In such instances, a combination of the resonance tube(s) 15 and the gas-distributing system 30 is termed herein as "resonance gas-distributing system" and designated by the reference numeral 35. For example, the resonance gas-distributing system 35 may comprise a plurality of resonance tubes, or tailpipes, 15, as shown in FIGS. 4, 1 and 9. In this respect, the distinction between the "gas-distributing system 30" and the "resonance gas-distributing system 35" is rather formal, and the terms "gas-distributing system" and "resonance gas-distributing system" are in most instances interchangeable.

Regardless of its specific embodiment, the gas-distributing system 30, or the resonance gas-distributing system 35, delivers the flow-reversing impingement air or gas onto the material 60. In several embodiments illustrated herein, it is done through at least one discharge outlet, or nozzle, 39. It is to be understood, however, that the flow-reversing impingement gaseous media can be delivered onto the material 60 using a single outlet, as shown, for example, in FIG. 21. The frequency F of the oscillatory flow-reversing impingement air or gas impinged upon the material 60 can be in a range of from about 15 Hz to about 3000 Hz. In some embodiments, the range of the frequency F can be from 15 Hz to 1500 Hz, more specifically from 15 Hz to 1000 Hz, and still more specifically, from 15 Hz to 500 Hz. If the pulse generator 20 comprises the pulse combustor 21, the frequency can typically be from 15 Hz to 500 Hz.

A typical pulse combustor 21 operates in the following manner. After air and fuel enter the combustion chamber 13 and mix therein, the detonator 14 detonates the air-fuel mixture, thereby providing start-up of the pulse combustor 21. The combustion of the air-fuel mixture creates a sudden increase in volume inside the combustion chamber 13, triggered by a rapid increase in temperature of the combustion gas. As the hot combustion gas expands, the inlet valves 11*a* and 12*a* close, thereby causing the combustion gas to expand into a resonance tube 15 which is in fluid communication with the combustion chamber 13. In FIG. 4, the resonance tube 15 also comprises the gas-distributing system 30 and thus forms the resonance gas-distributing system 35, as explained herein above. The gas-distributing system 30 has at least one discharge outlet 39 having an open area, designated as "A" in FIGS. 4A and 4B, through which open area A the hot oscillatory gas exits the gas-distributing system 30 (FIG. 4). In the pulse combustor, the temperature of the oscillatory gas at the exit from the discharge outlets is from about 500° F. to about 2500° F.

One skilled in the art will appreciate that FIG. 4 illustrates one type of the pulse combustor 21 that can be used in the present invention. A variety of pulse combustors is known in the art. Examples include, but are not limited to: gas pulse combustors commercially available from The Fulton® Companies of Pulaski, N.Y.; pulse dryers made by J. Jireh Corporation of San Rafael, Calif.; Cello® burners made by Sonotech, Inc. of Atlanta, Ga., and T-type burners made by Manufacturing Technology and Conversion, Inc. of Baltimore, Md. described in the Final Report entitled "Subpilot-Scale Testing of Acoustically Enhanced Cyclone" by M. A. Galica et al. of Solar Turbines, Inc., San Diego, Calif., for the U.S. Department of Energy, Office of Fossil Energy.

Figure 20:
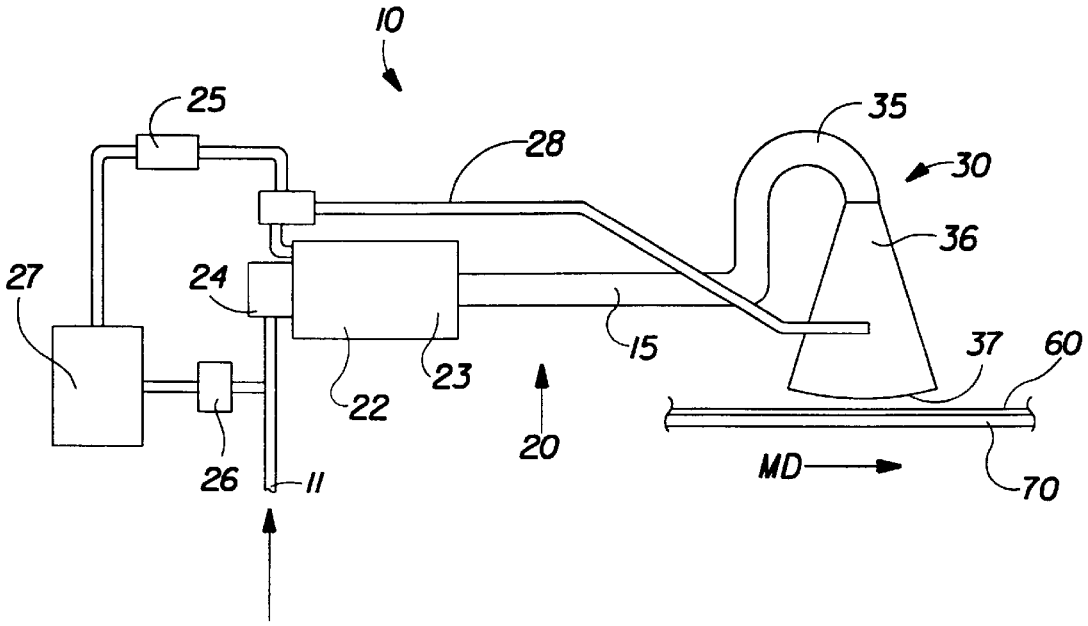
FIG. 20 is a schematic representation of an embodiment of the pulse generator useful in the present invention, comprising an infrasonic device.

FIG. 20 shows another embodiment of the pulse generator 20, comprising an infrasonic device 22. The infrasonic device 22 comprises a resonance chamber 23 which is in fluid communication with an air inlet 11 through a pulsator 24. The pulsator 24 generates an oscillating air having infrasound (low frequency) pressure which then is amplified in the resonance chamber 23 and in the resonance tube 15. The infrasonic device 22, shown in FIG. 20, further comprises a pressure-equalizing hose 28 for equalizing air pressure between the pulsator 24 and the diffuser 26, a transducer box 25 and an insonating controller 27 for controlling the frequency of pulsations. Various valves may also be used in the infrasonic device 22, for example a valve 26 controlling fluid communication between the insonating controller 27 and the air inlet 11. If the pulse generator 20 comprises the infrasonic device 22, the frequency of the oscillating flow-reversing air is from about 15 Hz to about 100 Hz. The infrasonic device 22 schematically shown in FIG. 20 is commercially made under the name INFRAFONE® by Infrafone AB Company of Sweden. Low-frequency sound generators are described in U.S. Pat. No. 4,517,915, issued May 21, 1985, to Olsson, et al; U.S. Pat. No. 4,650,413, issued Mar. 17, 1987, to Olsson, et al; U.S. Pat. No. 4,635,571, issued Jun. 13, 1987, to Olsson, et al; U.S. Pat. No. 4,592,293, issued Jun. 3, 1986, to Olsson, et al; U.S. Pat. No. 4,721,395, issued Jan. 26, 1988, to Olsson, et al; U.S. Pat. No. 5,350,887, issued Sep. 27, 1994, to Sandström, the disclosures of which patents are incorporated herein by reference for the purpose of describing an apparatus for generating low-frequency oscillations.

The apparatus 10 comprising the infrasonic device 22 may have a means (not shown) for heating, if desirable, the oscillatory air discharged by the infrasonic device 22. Such means, if desired, may comprise electrical heaters or temperature-controlled heat transfer elements located in an area adjacent to the impingement region. Alternatively, the material 60 may be heated through the support 70. It should be understood, however, that in some embodiments (at least at some steps of the papermaking process), the infrasonic device 22 may not have the means for heating. For example, the infrasonic device 22 may be used at the pre-drying stages of the papermaking process, in which instance the infrasonic device 22 is believed to be able to operate effectively at ambient temperature. The infrasonic device 22 can also be used to generate the oscillatory field which is then added to a steady flow impingement gas.

Figure 21:
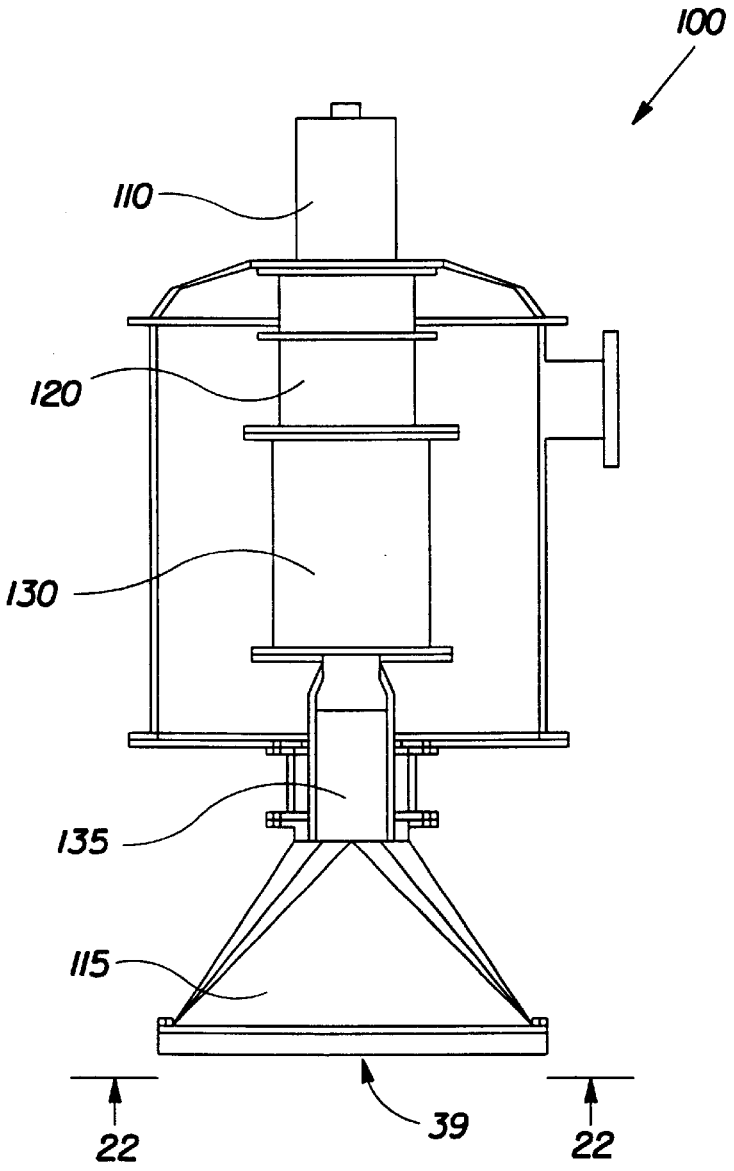
FIG. 21 is a schematic representation of an embodiment of the pulse generator comprising a rotary-valve pulse generator.
Figure 22:
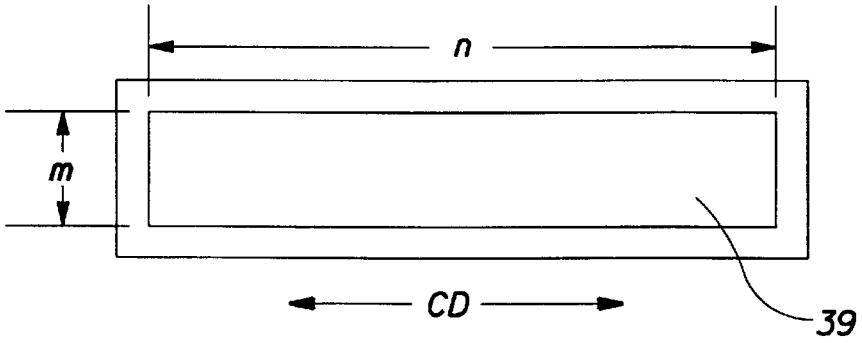
FIG. 22 is a view taken along lines 22—22 of FIG. 21, and showing an embodiment of the discharge outlet of the gas-distributing system of the present invention.

A rotary pulse generator 100, based on the designs disclosed in U.S. Pat. No. 4,708,159 issued Nov. 24, 1987 to Hanford Lockwood, is schematically shown in FIG. 21. Temperature-controlled air is forced under pressure, by a drive motor 110, through a coaxial rotating air valve 120 to produce pressure pulses which is forced through the Helmholtz resonator 130. The frequency of pulses is controlled by the rotational speed of the rotary air valve 120. The amplitude of the pressure pulses is increased by the resonance created by the standing acoustic wave within the Helmholtz resonator 130. The oscillatory pressure is converted to oscillatory flow reversing flow at the discharge end of the resonance tubes 135 and distributors 115. The rotary valve pulse generator generates oscillatory flow-reversing air having frequency from about 15 Hz to about 250 Hz. In the rotary valve pulse generator, the frequency F of the oscillatory flow-reversing impingement air or gas impinged upon the web 60 may be in a range of from about 15 Hz to about 1,500 Hz, more specifically from about 15 Hz to about 500 Hz, and still more specifically from about 15 Hz to about 250 Hz.

In the instance when the pulse generator 20 comprises the pulse combustor 21, the acoustic frequency of the oscillatory flow-reversing waves depends, at least partially, on the characteristics (such as flammability) of the fuel used in the pulse combustor 21. Several other factors, including design and geometry of the resonance system 30, may also effect the frequency of the acoustic field created by the flow-reversing impingement air or gas. For example, if the resonance system 30 comprises a plurality of resonance tubes 15, as schematically shown in FIGS. 1 and 9, such factors comprise, but are not limited to, a diameter D (FIG. 9) and the length L (FIG. 4) of the tube or tubes 15, number of the tubes 15, and a ratio of a volume of the resonance tube(s) 15 to a volume of the combustion chamber 13, or the resonance chamber 23.

A Helmholtz-type resonator may be used in the pulse generator 20 of the present invention. As one skilled in the art will recognize, the Helmholtz-type resonator is a vibrating system generally comprising a volume of enclosed air with an open neck or port. The Helmholtz-type resonator functions similarly to a resonance tube having an open and closed ends, described above. Standing acoustic waves having an antinode are produced at the open end of the Helmholtz-type resonator. Correspondingly, a node exists at the closed end of the Helmholtz-type resonator. The Helmholtz-type resonator may not have a constant diameter (and, therefore, volume) along its length. Typically, the Helmholtz-type resonator comprises a large chamber having a chamber volume Wr connected to the resonance tube having a tube volume Wt. The combination of elements having different volumes creates acoustic waves. The typical Helmholtz-type resonator, and thus Helmholtz-type pulse generator 20, useful in the present invention produces standing waves at the acoustic equivalence of one-quarter (¼) wavelength at a given sound frequency, as has been explained above. The acoustic wave frequency of the Helmholtz-type pulse generator 20 may be described by the following equation: $F=(C/2\pi L)\times(Wt/Wr)^{0.5}$, where: F is the frequency of the oscillatory flow-reversing air or gas, C is the speed of sound, L is the length of the resonance tube, Wt is the volume of the resonance tube, and Wr is the volume of the combustion chamber 13. Thus, the Helmholtz-type pulse generator 20 can be tuned to achieve a given sound frequency by adjusting the chamber volume Wr, the tube volume Wt, and the length L of the tube 15.

Figure 2:
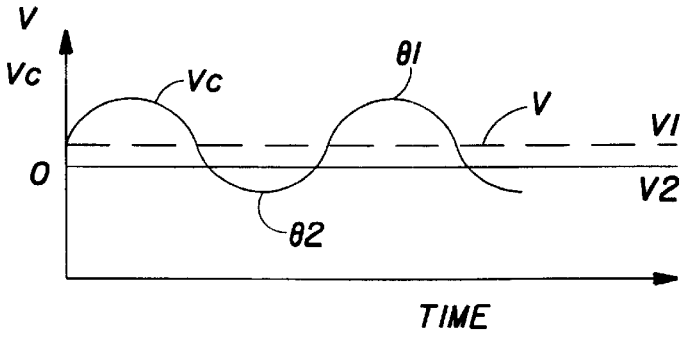
FIG. 2 is a diagram showing a cyclical velocity Vc and a mean velocity V of the oscillatory flow-reversing impingement air or gas, the cyclical velocity Vc comprising a positive-cycle velocity V1 and a negative cycle velocity V2.
Figure 3:
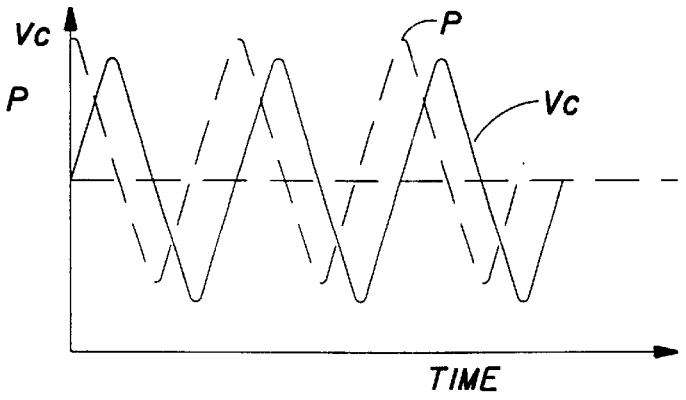
FIG. 3 is a diagram similar to the diagram shown in FIG. 2, and showing off-phase distribution of the cyclical velocity Vc relative to an acoustic pressure P.

The Helmholtz-type pulse generator 20 comprising the pulse combustor 21 is beneficial in some embodiments because of its high combustion efficiency and highlyresonant mode of operation. The Helmholtz-type pulse combustor 21 typically yields the highest pressure fluctuations per BTU (i. e., British Thermal Units) per hour of energy release within a given volume Wr of the combustion chamber 13. The resulting high level of flow oscillations provides a desirable level of pressure boost useful in overcoming the pressure drop of a downstream heat-exchange equipment. Pressure fluctuations in the Helmholtz-type pulse combustor 21 used in the present invention generally range from about 1 pound per square inch (psi) during negative peaks Q2 to about 5 psi during positive peaks Q1, as diagramatically shown in FIG. 2. These pressure fluctuations produce sound pressure levels from about 120 decibels (dB) to about 190 dB within the combustion chamber 13. FIG. 3 is a diagram similar to the diagram shown in FIG. 2, and showing off-phase distribution of the cyclical velocity Vc relative to the acoustic pressure P.

The oscillatory flow-reversing impingement gas has two components: a mean component characterized by a mean velocity V and a corresponding mean momentum M; and an oscillatory, or cyclical, component characterized by a cyclical velocity Vc and a corresponding cyclical momentum Mc. Not wishing to be limited by theory, the Applicant believes that the mean and oscillatory components of the flow-reversing impingement gas are principally created in the following manner. The gaseous combustion products exiting the combustion chamber 13 into the gas-distributing resonance system 30 have a significant mean momentum M (proportional to a mean velocity V of the combustion gas and its mass). When the burning of the air-fuel mixture is essentially complete in the combustion chamber 13, an inertia of the combustion gas exiting the combustion chamber 13 at high velocity creates a partial vacuum in the combustion chamber 13, which vacuum causes a portion of exiting combustion gas to return to the combustion chamber 13. The balance of the exhaust gas exit the pulse combustor 20 through the resonance system 30 at the mean velocity V. The partial vacuum created in the combustion chamber 13 opens the inlet valves 11*a* and 12*a* thereby causing the air and fuel to again enter the combustion chamber 13; and the combustion cycle repeats.

As used herein, the oscillatory cycles during which the combustion gas moves "forward" from the combustion chamber 13, and into, through, and from the gas-distributing system 30 are designated as "positive cycles"; and the oscillatory cycles during which a back-flow of the impingement gas occurs are termed herein as "negative cycles." Correspondingly, an average amplitude of the positive cycles is a "positive amplitude"; and an average amplitude of the "negative cycles" is a "negative amplitude." Analogously, during the positive cycles, the impingement gas has a "positive velocity" V1 directed in a "positive direction" D1 towards the material 60 disposed on the support 70; and during the negative cycles, the impingement gas has a "negative velocity" V2 directed in a "negative direction." The positive direction D1 is opposite to the negative direction D2, and the positive velocity V1 is opposite to the negative velocity V2. The cyclical velocity Vc defines an instantaneous velocity of the oscillatory-flow gas at any given moment during the process, while the mean velocity V characterizes a resulting velocity of the flow-reversing oscillatory field formed by the combustion gas vibrating at the frequency F comprising a sequence of the positive cycles alternating with the negative cycles. One skilled in the art will appreciate that the positive velocity component V1 is greater than the negative velocity component V2, and the mean velocity V has the positive direction D1, hence the resulting oscillatory impingement gas move in the positive direction D1, i. e., exits the pulse combustor 20 into the gas-distributing system 30. It should also be appreciated that since the cyclical velocity Vc constantly changes from the positive velocity V1 to the negative velocity V2 opposite to the positive velocity V1, there must be an instance when the cyclical velocity Vc changes its direction, i. e., the instance when Vc=0 relative to V1 and V2. Consequently, each of the positive velocity V1 and the negative velocity V2 changes its absolute value from zero to maximum to zero, etc. Therefore, it could be said that the positive velocity V1 is an average cyclical velocity Vc during the positive cycles, and the negative velocity V2 is an average cyclical velocity Vc during the negative cycles of the flow-reversing impingement gas.

It is believed that the mean velocity V may be determined by at least two factors. First, the air and the fuel fired in the combustion chamber 13 preferably produces a stoichiometric flow of gas over a desired firing range. If, for example, the combustion intensity needs to be increased, a fuel-feed rate may be increased. As the fuel-feed rate increases, the strength of the pressure pulsation in the combustion chamber 13 increases correspondingly, which, in turn, increases the amount of air aspirated by the air valve 11*a*. Thus, the use of the pulse combustor 21 that is capable of automatically maintaining a substantially constant stoichiometry over the desired firing rate is believed to be beneficial for the present invention. Of course, the combustion stoichiometry may be changed, if desired, by modifying the operational characteristics of the valves 11*a*, 12*a*, geometry of the pulse combustor 21 (including its resonance tailpipe 15), and other parameters. Second, since the combustion gases have a much higher temperature relative to the temperature of the inlet air and fuel, a viscosity of the inlet air and fuel is higher than a viscosity of the combustion gases. The higher viscosity of the inlet air and fuel causes a higher flow resistance through the valves 11*a* and 12*a*, relative to a flow resistance through the resonating system 30.

According to the present invention, the pulse combustor 21 produces an intense acoustic pressure P, in the order of 160–190 dB, inside the combustion chamber 13. The acoustic pressure P reaches its maximum level in the combustion chamber 13. Due to the open end of the resonance tube(s) 15, the acoustic pressure P is reduced at the exit of the resonance tube(s) 15. This drop in the acoustic pressure P results in a progressive increase in cyclical velocity Vc which reaches its maximum at the exit of the resonance tube(s) 15. It is believed to be beneficial to have the Helmholtz-type pulse generator 20 in which the acoustic pressure is minimal at the exit of the resonance tube(s) 15—in order to achieve a maximal cyclical velocity Vc in the exhaust flow of oscillatory impingement gases. The decreasing acoustic pressure P beneficially reduces noise typically associated with sonically enhanced processes of the prior art. For example, in some experiments with the pulse combustor 21, conducted in accordance with the present invention with respect to paper web dewatering, the acoustic pressure P measured at the distance of from about 1.0 inch to about 2.5 inches from the discharge outlet(s) 39 was approximately from 90 dB to 120 dB. Thus, at least one embodiment of the process and the apparatus 10 of the present invention operate at a significantly lower noise level relative to the prior art's sonically-enhanced steady impingement processes having the average acoustic pressure of up to 170 dB (see, for example, U.S. Pat. No. 3,694,926, 2:16–25).

Figure 5:
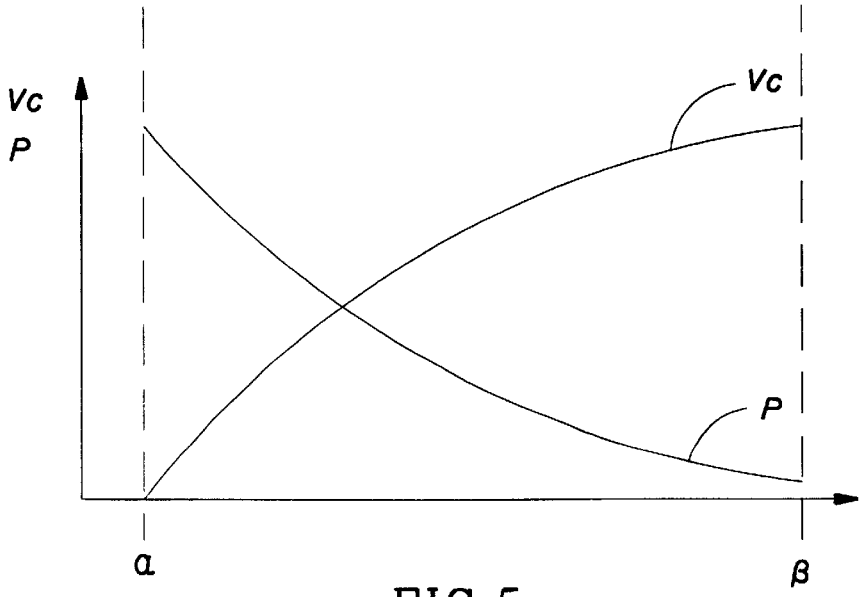
FIG. 5 is a diagram showing interdependency between the acoustic pressure P and the positive velocity Vc within the pulse combustor.

At the exit of the gas-distributing system 30, the cyclical velocity Vc, ranging from about 1,000 feet per minute (ft/min) to about 50,000 ft/min, and more specifically from about 2,500 ft/min to about 50,000 ft/min, can be calculated based on the measured acoustic pressure P in the combustion chamber 13. The cyclical velocity Vc can be from about 5,000 ft/min to about 50,000 ft/min. A diagram in FIG. 5 schematically shows interplay between the acoustic pressure P and the cyclical velocity Vc. As has been explained above, according to one embodiment of the process of the present invention, the cyclical velocity Vc increases within the pulse generator 20, reaching its maximum at the exit from the gas-distributing system 30 through the discharge outlet(s) 39, while the acoustic pressure P, produced by the explosion of the fuel-air mixture within the combustion chamber 13, decreases. (In the diagram of FIG. 5, a symbol "a" corresponds to a location inside the combustion chamber 13, where the initial combustion takes place, and a symbol "b" corresponds to the exit from the discharge outlets 39.) According to the present invention, the mean velocity V is from about 1,000 ft/min to about 25,000 ft/min, and a ratio Vc/V is from about 1.1 to about 50.0. More specifically, the mean velocity V is from about 2,500 ft/min to about 25,000 ft/min, and the ratio Vc/V is from about 1.1 to about 20.0. More specifically, the mean velocity V is from about 5,000 ft/min to about 25,000 ft/min, and the ratio Vc/V is from about 1.1 to about 10.0. The cyclical velocity Vc, increases in amplitude from the resonance tube's inlet to the resonance tube's outlet and thus to the discharge outlet 39 of the gas-distributing system 30. This further improves convective heat transfer between the combustion gas and the inner walls of the gas-distributing system 30. According to the present invention, maximum heat transfer is achieved at the exit of the discharge outlets 39 of the gas-distributing system 30.

Pulse combustion is described in several sources, such as, for example, Nomura, et al., Heat and Mass Transfer Characteristics of Pulse-Combustion Drying Process, *Drying'89*, Ed. A. S. Mujumdar and M. Roques, Hemispher/Taylor Francis, N. Y., p.p. 543–549, 1989; V. I. Hanby, Convective Heat Transfer in a Gas-Fired Pulsating Combustor, *Trans. ASME J. of Eng. For Power,* vol. 91A, p.p. 48–52, 1969; A. A. Putman, Pulse Combustion, *Progress Energy Combustion Science,* 1986, vol. 12, p.p. 4–79, Pergamon Journal LTD; John M. Corliss, et al., Heat-Transfer Enhancement By Pulse Combustion In Industrial Processes, *Procedures of* 1986 *Symposium on Industrial Combustion Technology,* Chicago, p.p. 39–48, 1986; P. A. Eibeck et al, Pulse Combustion: Impinging Jet Heat Transfer Enhancement, *Combust. Sci. and Tech.,* 1993, Vol. 94, pp. 147–165. These articles are incorporated by reference herein for the purpose of describing pulse combustion and various types of pulse combustors. It should be carefully noted, however, that for the purposes of the present invention, only those pulse combustors are suitable that are capable of creating the impingement gas having oscillating sequence of the positive cycles and the negative cycles, or—as used herein—oscillating flow-reversing impingement gas. The flow-reversing character of the impingement gas provides significant dewatering and energy-saving benefits over the prior art's steady-flow impingement gas, as will be shown further herein below.

The apparatus 10 of the present invention, including the pulse generator 20 and the support 70, is designed to be capable of discharging the oscillatory flow-reversing impingement air or gas onto the material 60 according to a pre-determined, and preferably controllable, pattern. FIGS. 1, 6, 7, and 8 show several principal arrangements of the pulse generator 20 relative to the support 70. In FIG. 1, the pulse generator 20 discharges the oscillatory flow-reversing impingement air or gas onto the material 60 supported by the support 70 and traveling in a machine direction, or MD. As used herein, the "machine direction" is a direction which is parallel to the flow of the material 60 through the equipment. A cross-machine direction, or CD, is a direction which is perpendicular to the machine direction and parallel to the general plane of the material 60. In FIGS. 1, the resonance gas-distributing system 35 is schematically shown as comprising several cross-machine-directional rows of resonance tubes, or slots, 15, each having at least one discharge outlet 39. However, it should be understood that the number of the tubes 15 or outlets 39, as well as a pattern of their distribution relative to the surface of the material 60, may be influenced by various factors, including, but not limited to, parameters of the overall dewatering process, characteristics (such as temperature) of the impingement air or gas, type of the material 60, an impingement distance Z (FIGS. 1 and 7A) formed between the discharge outlets 39 and the support 70, residence time, the desired fiber-consistency of the material 60 after the dewatering process of the present invention is completed, and others. The outlets 39 need not have a round shape of an exemplary embodiment shown in FIG. 9. The outlets 39 may have any suitable shape, including but not limited to a generally rectangular shape shown in FIG. 4B. The gas-distributing system 30 comprising a single outlet 39 is also contemplated in the present invention.

As used herein, the term "impingement distance, " designated as "Z," means a clearance formed between the discharge outlet or outlets 39 of the gas-distributing system 30 and the upper surface of the support 70. In one embodiment of the apparatus 10 of the present invention, a means for controlling the impingement distance Z may be provided. Such means may comprise conventional manual mechanisms, as well as automated devices, for causing the outlets 39 of the gas-distributing system 30 and the support 70 to move relative to each other, i. e., toward and away from each other, thereby adjusting the impingement distance Z. Prophetically, the impingement distance Z may be automatically adjustable in response to a signal from a control device 90, as schematically shown in FIG. 1. The control device measures at least one of the parameters of the dewatering process or one of the parameters of the material 60. For example, the control device may comprise a moisture-measuring device which is designed to measure the moisture content of the material 60 before and/or after the material 60 is subjected to water removal, or during the process of water removal (FIG. 1). When the moisture content of the material 60 is higher or lower then a certain pre-set level, the moisture-measuring device sends an error signal to adjust the impingement distance Z accordingly. Alternatively or additionally, the control device 90 may comprise a temperature sensor designed to measure the temperature of the material 60 while the material 60 is subjected to the flow-reversing impingement according to the present invention. Some materials, for example, paper, ordinarily tolerate temperatures not greater than 300° F.–400° F. Therefore, control of the temperature of the material 60 may be important, especially in the process of the present invention, in which the flow-reversing impingement gas may have the temperature up to 2500° F. when exiting the discharge outlets 39 of the gas-distributing system 30. Prophetically, therefore, the impingement distance Z can be automatically adjustable in response to a signal from the control device 90, which is designed to measure the temperature of the material 60. When the temperature of the material 60 is higher than a certain pre-selected threshold, the control device 90 sends an error signal to accordingly adjust (presumably, increase) the impingement distance Z, thereby creating conditions for decreasing the temperature of the material 60. These and other parameters of the dewatering process, alone or in combination, may be used as input characteristics for adjusting the impingement distance Z. It is to be understood that the impingement distance Z may, in some embodiments of the process of the present invention, be dependent on the type of the material 60 and its thickness when the material 60 is disposed on the support 70. The impingement distance Z is from about 0.25 inches to about 24.0 inches, depending on the material being dewatered or dried.

The present invention is applicable to any material in either continuous or discontinuous form. The material may be a web, granular, foam or any solid structure capable of being supported on a conveyance device. Examples include the following: solid substances such as clothes, carpets, food products, building materials and plastic items; granular substances such as coffee, cocoa and tablets; paste-like materials such as sludge, foamed extracts; thin films such as plastics, formed materials such as extrudates; and webs such as non-woven and paper. The support may include a variety of structures such as a band, belt, wire, screen, or drying cylinder. In the embodiment comprising a continuous process, the support travels in the machine direction at a transport velocity.

The thickness of the material 60 is somewhat dependent on its nature and on whether the material 60 is in continuous or discontinuous form. The thickness can range from a few mils in the case of webs to several centimeters in the case of granular material. The major limitation on material thickness is the ability of the oscillatory flow reversing gas to penetrate the material and for the evaporated water to be removed from the material. In the instance of particulate materials, it may be beneficial to mechanically agitate the support, in order to facilitate movement of the particles of the material relative to one another, "stir" or turn over the material, to expose different surfaces thereof to the pulse oscillatory flow reversing gas jet.

It may be beneficial to remove the moisture from the impingement region by providing a vacuum source and at least one vacuum slot extending from the vacuum source to the impingement region and providing a fluid communication between the vacuum source and the impingement region, as described and shown herein (FIG. 1).

Figure 4A:
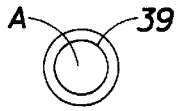
FIG. 4A is a partial view taken along line 4A—4A of FIG. 4, and showing a round discharge outlet of the pulse combustor, the discharge outlet having a diameter D and an open area A.

The impingement distance Z defines an impingement region, i. e., the region between the discharge outlet(s) 39 and the support 70, which region is penetrable by the oscillatory flow-reversing gas produced by the pulse generator 20. In some embodiments of the apparatus 10 and the process of the present invention, a ratio of the impingement distance Z to an equivalent diameter D of the discharge outlet 39, i. e., the ratio Z/D, is from about 1.0 to about 10.0. The "equivalent diameter D" is used herein to define the open area A of the outlet 39 having a non-circular shape, in relation to the equal open area of the outlet 39 having a circular geometrical shape. An area of any geometrical shape can be described according to the formula: $S=\frac{1}{4}\pi D^2$, where S is the area of any geometrical shape, $\pi=3.14159$, and D is the equivalent diameter. For example, the open area of the outlet 39 having a rectangular shape can be expressed as a circle of an equivalent area "s" having a diameter "d." Then, the diameter d can be calculated from the formula: $s=\frac{1}{4}d^2$, where s is the known area of the rectangle. In the foregoing example, the "diameter" d is the equivalent diameter D of this rectangular. Of course, the equivalent diameter of a circle is the circle's real diameter (FIGS. 4 and 4A).

Various designs of the gas-distributing system 30 suitable for delivering the oscillatory field of flow-reversing gas onto the material 60 include those comprising a single straight tube, or slot, 15 (FIG. 4), or a plurality of tubes 15 (FIG. 1). The geometrical shape, relative size, and the number of the tubes 15 depend upon the required heat transfer profile, the relative size of an area of the drying surface, and other parameters of the process. Regardless of its specific design, the gas-distributing system 30 must possess certain characteristics. First, if the gas-distributing system 30 comprises resonance tubes 15 thereby forming the resonance gas-distributing system 35, as was explained above, the resonance gas-distributing system 35 must transform, or convert, the combustion gas produced inside the combustion chamber 13 into the oscillatory flow-reversing impingement gas, as described above. Second, the gas-distributing system 30 must deliver the oscillatory flow-reversing impingement gas onto the material 60. By the requirement that the gas-distributing system 30 must deliver the impingement gas onto the material 60, it is meant that the impingement gas must actively engage the moisture contained in the material 60 such as to at least partially remove this moisture from the material 60 and from a boundary layer adjacent to the material 60. It should be understood that the requirement that the impingement gases be delivered onto the material 60 does not exclude that the impingement gases may penetrate, at least partially, the material 60. Of course, in some embodiments of the present invention, the impingement gases can penetrate the material 60 throughout the entire thickness of the material 60, thereby displacing, heating, evaporating and removing water from the material 60.

Figure 11:
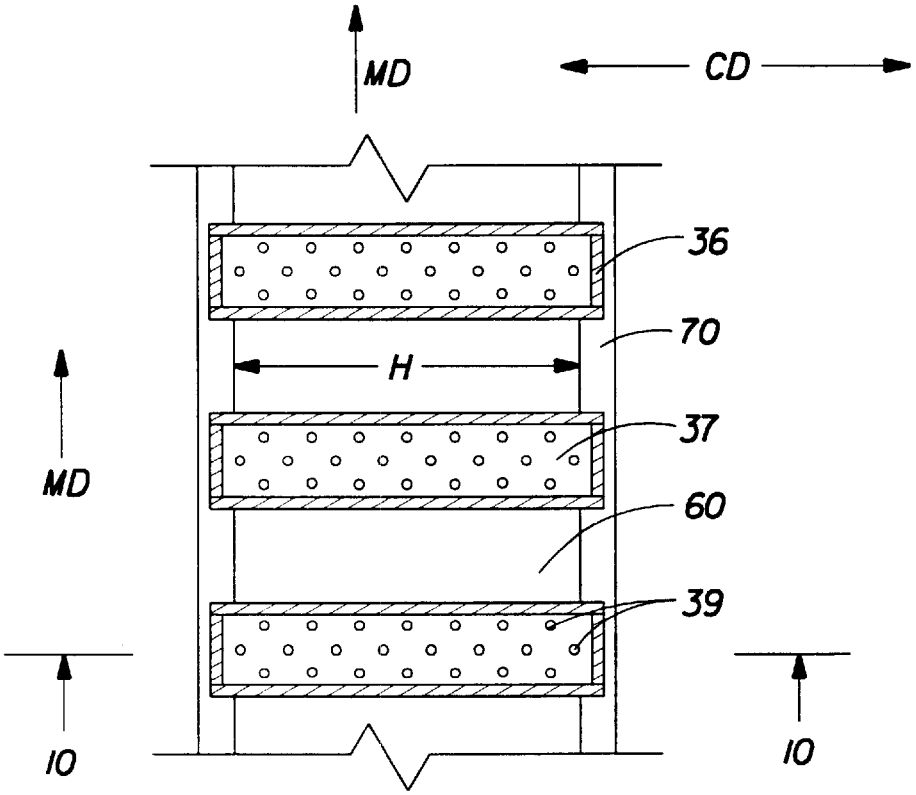
FIG. 11 is a schematic plan view, taken along line 11—11 of FIG. 10, and showing multiple blow boxes successively spaced in the machine direction.

The design of the gas-distributing system 30 can be critical for obtaining desirable high water-removal rates, for example—in the instance of dewatering a paper web in accordance with the present invention—up to 150 pounds per square foot per hour ($lb/ft^2 \cdot hr$) and higher. Not only a resulting open area of the discharge outlets 39, in relation to an impingement area of the material 60, is important, but also a pattern of distribution of the discharge outlets 39 throughout the impingement area of the material 60. As used herein, the term "resulting open area," designated as "ΣA," refers to a combined open area formed by all individual open areas A of the outlets 39 together, in relation to a certain area of the material 60. An area of a portion of the material 60 impinged upon by the oscillatory flow-reversing impingement field corresponding to the resulting open area ΣA at any moment of the continuous process is designated herein as an "impingement area E." The impingement area E can be calculated as E=RH, where R is a length of the impingement area E (FIG. 1), and H is a width of the material 60 (FIGS. 9 and 11). The distance R is defined by the geometry of the gas-distributing system 30, specifically by a machine-directional dimension of the pattern of the plurality of the discharge outlets 39, as best shown in FIG. 1. The impingement area E is, in other words, an area corresponding to a region outlined by the pattern of the plurality of the discharge outlets 39. A relationship between the resulting open area ΣA and the impingement area E can be defined by a ratio ΣA/E, which may, in some embodiments, be from 0.002 to 1.000, and more specifically from 0.005 to 0.200.

For example, for the material 60 comprising a paper web having moisture content from about 10% to about 60%, the water-removal rates are higher than 25–30 $lb/ft^2 \cdot hr$. More specifically, the water-removal rates are higher than 50–60 $lb/ft^2 \cdot hr$., and in some embodiments, even higher than 75 $lb/ft^2 \cdot hr$. In order to achieve the desired water-removal rates for the material 60, the oscillatory flow-reversing impingement gas should preferably form an oscillatory "flow field" substantially uniformly contacting the material 60 throughout the surface of the material 60, at the impingement area E. The oscillatory field can be created when the flow of the oscillatory gas from the gas-distributing system 30 is substantially equally split and impinged onto the drying surface of the material 60 through a network of the discharge outlets 39. Also, temperature control of the oscillatory impingement gas within the gas-distributing system 30 may be necessary due to possible density effects within the pulse combustor 21 and the gas-distributing system 30. Control of the gas temperature at the exit from the gas-distributing system 30 through the discharge outlet(s) 39 is desirable because it helps one to control the water-removal rates in the process. One skilled in the art will appreciate that control of the gas temperature can be accomplished by the use of water-cooled jackets or air/gas-cooling of the outside surfaces of the pulse combustor 21 and the gas-distributing system 30. Pressurized cooling air and heat-transfer fins may also be used to control the gas temperature at the discharge outlets 39 and to recover heat in the pulse combustor 21, as well as to control the location of the combustion flame front in the resonance tube(s) 15.

It has been found that the oscillatory field can be distributed using the outlet or outlets 39 having a variety of geometrical shapes, provided several guidelines are preferably followed. First, the resonance gas-distributing system 35 should preferably have equal volumes and lengths in each tube 15, in order to maintain such acoustic-field properties as to ensure that the acoustic pressure generated in the combustion chamber 13 is maximally and uniformly converted into the oscillatory field at the exit from the discharge outlets 39. Second, the design of the resonance gas-distributing system 35 (or of the gas-distributing system 30) should preferably minimize "back" pressure in the combustion chamber 13. Back pressure may adversely effect the operation of the air valve 11*a* (especially, when it is of aerodynamic nature), and consequently reduce the dynamic pressure generated by the pulse combustor, and the oscillatory velocity Vc of the impingement gases. Third, the resulting open area ΣA of the plurality of the discharge outlets 39 should correlate with a resulting open (cross-sectional) area of the tube or tubes 15. It means that in some embodiments the resulting open area ΣA of the plurality of the discharge outlets 39 should preferably be equal to a resulting open (cross-sectional) area of the tube or tubes 15. In other embodiments, however, it may be desirable to have unequal open areas to provide control of the (presumably uniform) temperature profile of the oscillatory field of the flow-reversing gas. By analogy with the resulting open area ΣA of the discharge outlets 39, one skilled in the art would understand that the "resulting open area of the tube or tubes 15" refers to a combined open area formed by the individual tube or tubes 15, as viewed in an imaginary cross-section perpendicular to a stream of oscillatory gas.

Figure 4B:
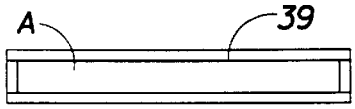
FIG. 4B is another embodiment of the discharge outlet of the pulse combustor, having a rectangular shape.

A pattern of distribution of the discharge outlets 39 in plan view, relative to the material 60, may vary. FIG. 9, for example, shows a non-random staggered array of distribution. Patterns of distribution comprising non-random staggered arrays facilitate more even application of the impingement gas, and therefore more uniform distribution of the gas temperature and velocity, relative to the impingement area of the material 60. The discharge outlets 39 may have a substantially rectangular shape, as shown in FIGS. 4B. Such rectangular discharge outlets 39 can be designed to cover the entire width of the material 60, or—alternatively—any portion of the width of the material 60.

Figure 10:
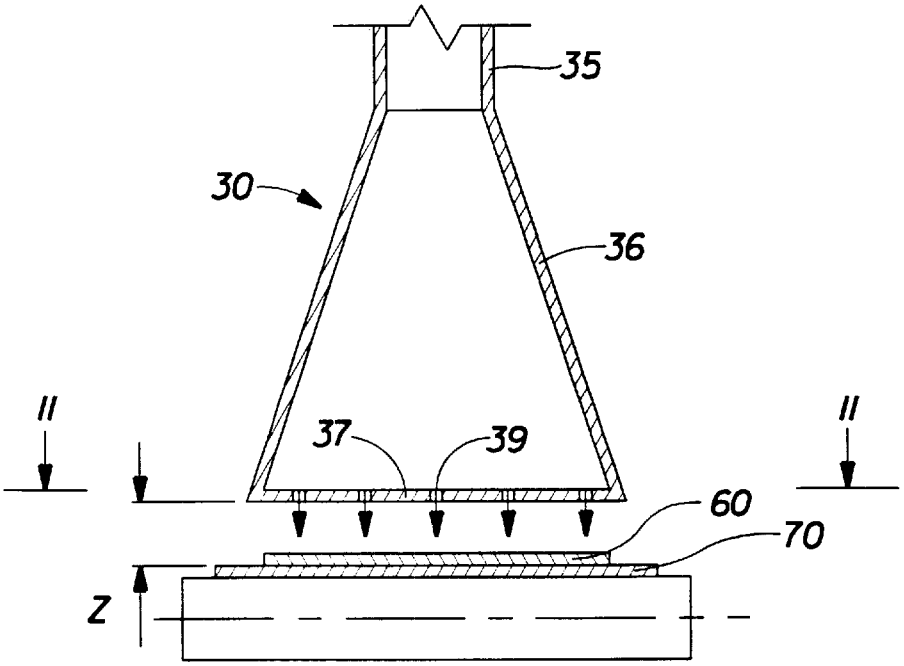
FIG. 10 is a schematic cross-sectional view of one embodiment of the pulse generator's gas-distribution system terminating with a blow box having a plurality of discharge orifices extending through the blow box's bottom.
Figure 12:
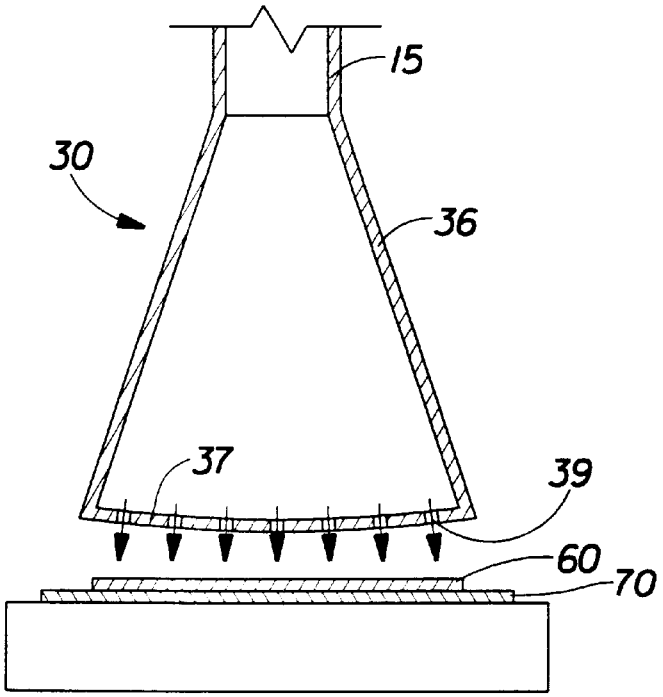
FIG. 12 is a schematic cross-sectional view of an embodiment of the blow box having a curved convex bottom.
Figure 13A:
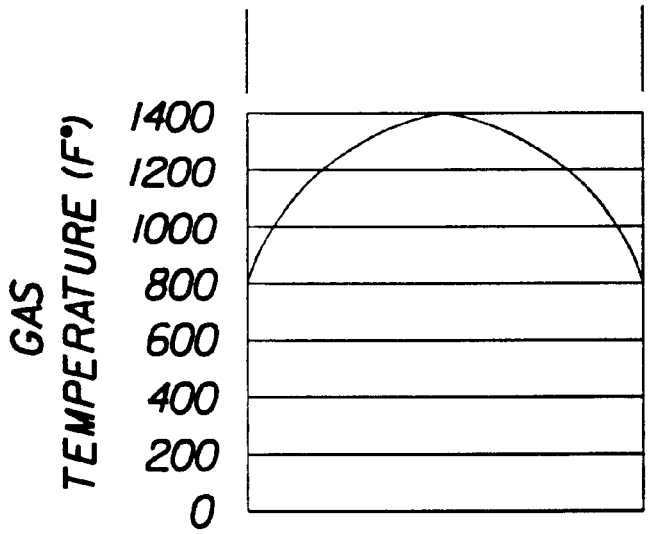
FIG. 13A is a schematic diagram showing distribution of the temperature of the oscillatory flow-reversing gas or air at the exit from the blow-box having the curved bottom schematically shown in FIG. 12, or sectional bottom schematically shown in FIG. 13.
Figure 14:
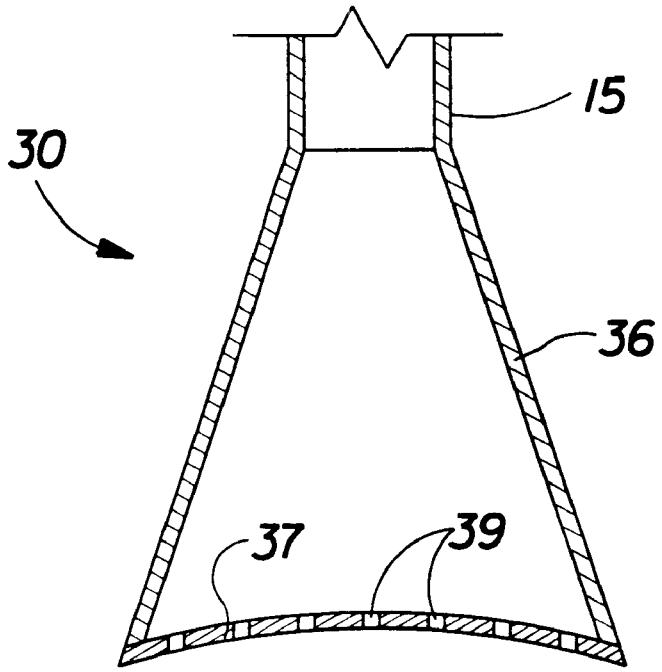
FIG. 14 is a schematic cross-sectional view of an embodiment of the blow box having a curved concave bottom.
Figure 14A:
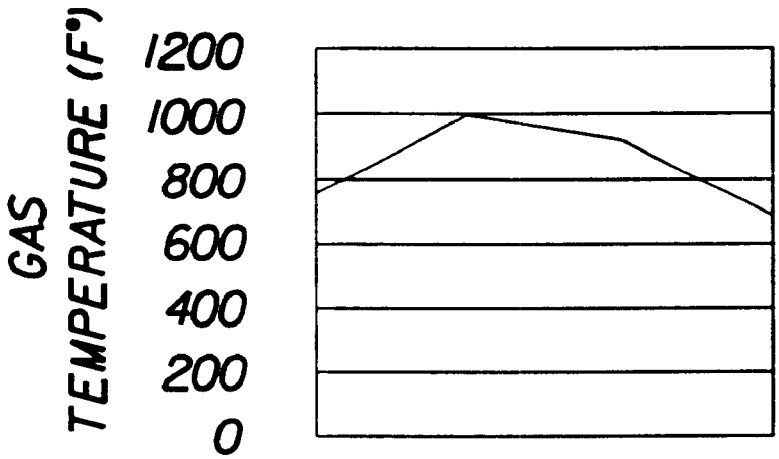
FIG. 14A is a schematic diagram showing distribution of the temperature of the flow-reversing impingement gasses at the exit from the blow-box having the curved concave bottom schematically shown in FIG. 14.

FIGS. 10 and 11 show the gas-distributing system 30 comprising a plurality of blow boxes 36, each terminating with a bottom plate 37 comprising the plurality of the discharge outlets 39. The discharge outlets 39 can be formed as perforations through the bottom plate 37, by any other method known in the art. In FIG. 10, the blow box 36 has a generally trapezoidal shape, but it should be understood that other shapes of the blow box 36 are possible. Likewise, while the blow box shown in FIG. 10 has a substantially planar bottom plate 37, it has been discovered that a non-planar or curved shape of the bottom plate 37 may be possible, and even preferable. For example, FIG. 12 shows the blow box 36 having a convex bottom plate 37; and FIG. 14 shows the blow box 36 having a concave bottom plate 37. It has been found that the convex shape of the bottom plate 37 may provide higher temperatures of the oscillatory gas in the impingement region, relative to the planar shape of the bottom plate 37, FIG. 13A. At the same time, the concave shape of the bottom plate 37 provides a more uniform distribution of the gas temperature across the impingement area of the material 60, relative to the temperature distribution provided by the planar bottom plate, all other characteristics of the process and the apparatus being equal, FIG. 14A.

Figure 13:
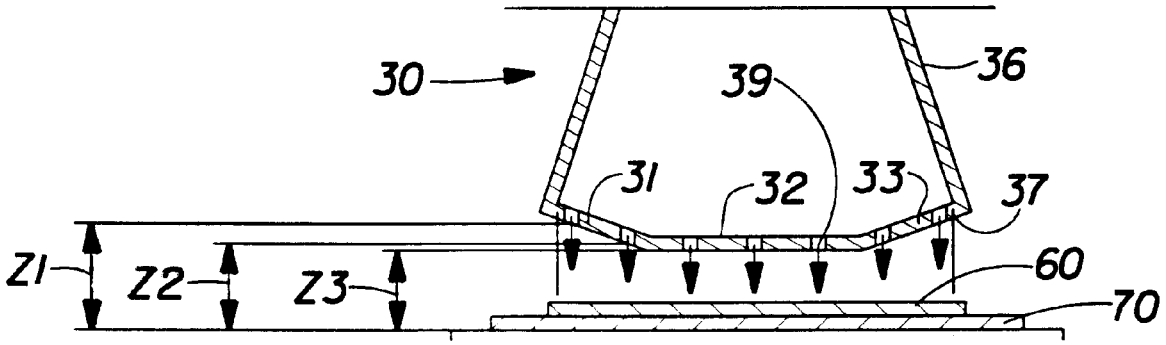
FIG. 13 is a schematic cross-sectional view of an embodiment of the blow box having a bottom comprising a plurality of interconnected sections forming a generally convex shape of the blow box's bottom.

While FIG. 12 shows the bottom plate 37 which is convex and is curved in cross-section, FIG. 13 shows another embodiment of a generally convex bottom plate 37, formed by a plurality of sections. FIG. 13 schematically shows the bottom plate 37 comprising three sections: a first section 31, a second section 32, and a third section 33. In the shown cross-section, the sections 31, 32, and 33 form angles therebetween, thereby forming a "broken line" in the cross-section shown. Of course, a number of the sections, as well as their shape may differ from those shown in FIG. 13. For example, each of the sections 31, 32, and 33, shown in FIG. 13 has a substantially planar cross-sectional configuration. However, each of the sections 31, 32, and 33 may be individually curved (not shown), analogously to the bottom plate 37 shown in FIG. 12.

One skilled in the art should appreciate that, the impingement distance Z, defined herein above, may differentiate among the discharge outlets 39. Therefore, as used herein, the impingement distance Z is an average arithmetic of all individual impingement distances. For example, in FIGS. 12 and 13, the impingement distance Z is an average of individual Z1, Z2, Z3, etc. formed between the surface of the support 70 and respective individual discharge outlets 39, taking into account relative open areas A and relative numbers of the discharge outlets 39 per unit of the impingement area of the material 60. For example, FIG. 13 shows that the bottom plate 37 has, in the cross-section, three discharge outlets 39 (in the section 32) having the impingement distance Z3, two discharge outlets 39 (one in each of the sections 31 and 33) having the impingement distance Z2, and two discharge outlets 39 (one in each of the sections 31 and 33) having the impingement distance Z2. Then, assuming that all discharge outlets 39 have mutually equal open areas A, the impingement distance for the entire bottom plate is computed as $(Z3\times3+Z1\times2+Z2\times2)/7$. If the discharge outlets 39 have unequal open areas A, the differential areas A should be included into the equation, to account for differential contribution of the individual discharge outlets 39. The individual impingement distance Z1, Z2, Z3, etc. is measured from the point in which a geometrical axis of the discharge outlet 39 crosses an imaginary line formed by a material to be dewatered or dried-facing surface of the bottom plate 37. The same method of computing the impingement distance Z may be applied, if appropriate, in the context of the support 70 comprising a drying cylinder 80, FIGS. 7, 7A and 8(IV), as one skilled in the art will appreciate.

Figure 9A:
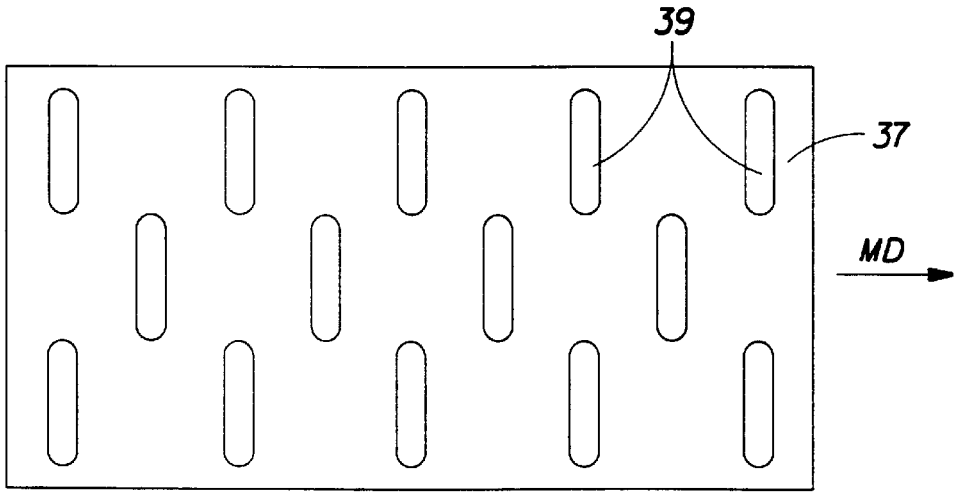
FIG. 9A is a schematic plan view of the discharge outlets, comprising a substantially rectangular orifices distributed in a non-random pattern.

Other designs and permutations of the gas-distributing system 30, including the discharge outlets 39, are contemplated in the present invention. For example, a single discharge orifice or a plurality of discharge orifices in the plates 37 may comprise oblong slit-like holes distributed in a pre-determined pattern, as schematically shown in FIG. 9A. Likewise, a combination (not shown) of the round discharge outlets 39 and the slit-like discharge outlets 39 may be used, if desired, in the apparatus 10 of the present invention.

It is also believed that an angled application of the oscillating flow-reversing gaseous media may be beneficially used in the present invention. By "angled" application it is meant that the positive direction of the stream of the oscillating air or gas and the surface of the support 70 form an acute angle therebetween. FIGS. 12 and 13 can illustrate such an angled application of the oscillating impingement air or gas. It should be carefully noted, however, that the angled application of the oscillating air or gas is not necessarily consequential of the convex, concave, or otherwise curved (or "broken" ) shape of the bottom plate 37. In other words, the curved or broken bottom plate 37 can be easily designed to provide a non-angled (i. e., perpendicular to the support 70) application of the oscillating air or gas, as best shown in FIG. 13. Similarly, the planar bottom plate 37 can comprise the discharge outlets 39 designed to provide the angled application of the oscillatory flow-reversing air or gas (not shown). Of course, the angled application of the oscillatory air or gas may be provided by a means other than the blow box 36, for example, by a plurality of individual tubes, each terminating with the discharge outlet 39, and without the use of the blow box 36. While declining to be limited by theory, Applicant believes that the benefits provided by the angled application of the oscillating air or gas may be attributed to the fact that a "wiping" effect of the angled streams of oscillating air or gas is facilitated by the existence of the acute angle(s) between the gas stream(s) and the surface of the material 60.

Figure 12A:
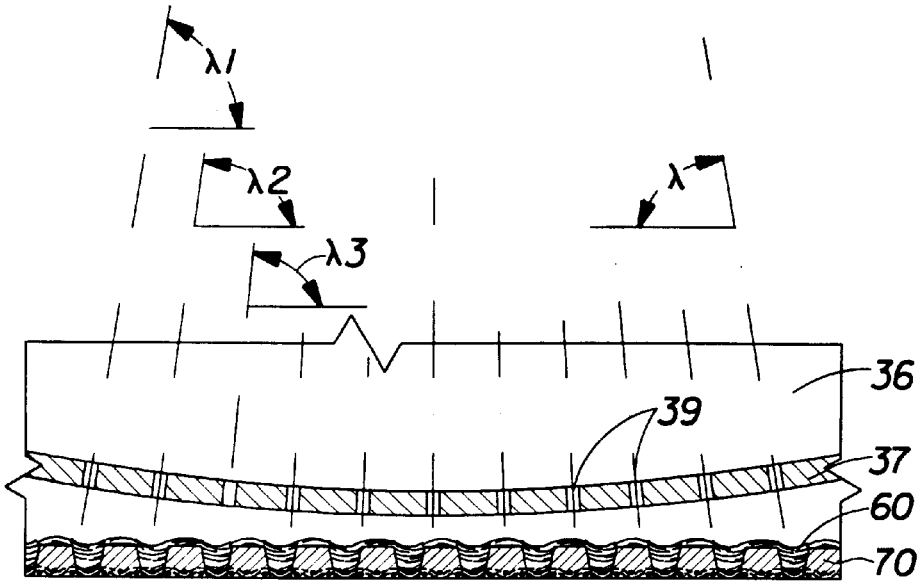
FIG. 12A is a schematic and more detailed cross-sectional view of the blow box shown in FIG. 12, providing an angled application of the oscillatory air or gas, relative to a fluid-permeable support.

In FIG. 12A, a symbol "$\lambda$" designates a generic angle formed between the general, or macroscopically monoplanar, surface of the support 70 and the positive direction of the oscillating stream of air or gas through the discharge outlet 39. As used herein, the terms "general" surface (or plan) and "macroscopically monoplanar" surface both indicate the plan of the support 70 when the support 70 is viewed as a whole, without regard to structural details. Of course, minor deviation from the absolute planarity may be tolerable, while not preferred. It should also be recognized that the angled application of the oscillating flow-reversing air or gas may be possible relative to the cross-machine direction (FIG. 12), the machine direction (not shown), and both the machine direction and the cross-machine direction (not shown). According to the present invention, the angle $\lambda$ is from almost 0° to 90°. Also, the individual angles $\lambda$ ($\lambda$1, $\lambda$2, $\lambda$3) can (and in some embodiments preferably do) differentiate therebetween, as best shown in FIG. 12A: $\lambda 1>\lambda 2>\lambda 3$. One skilled in the art will appreciate that the teachings provided herein above with regard to the angle $\lambda$ may also be applicable, by analogy, to the concave bottom plate 37, shown in FIG. 14.

Figure 15:
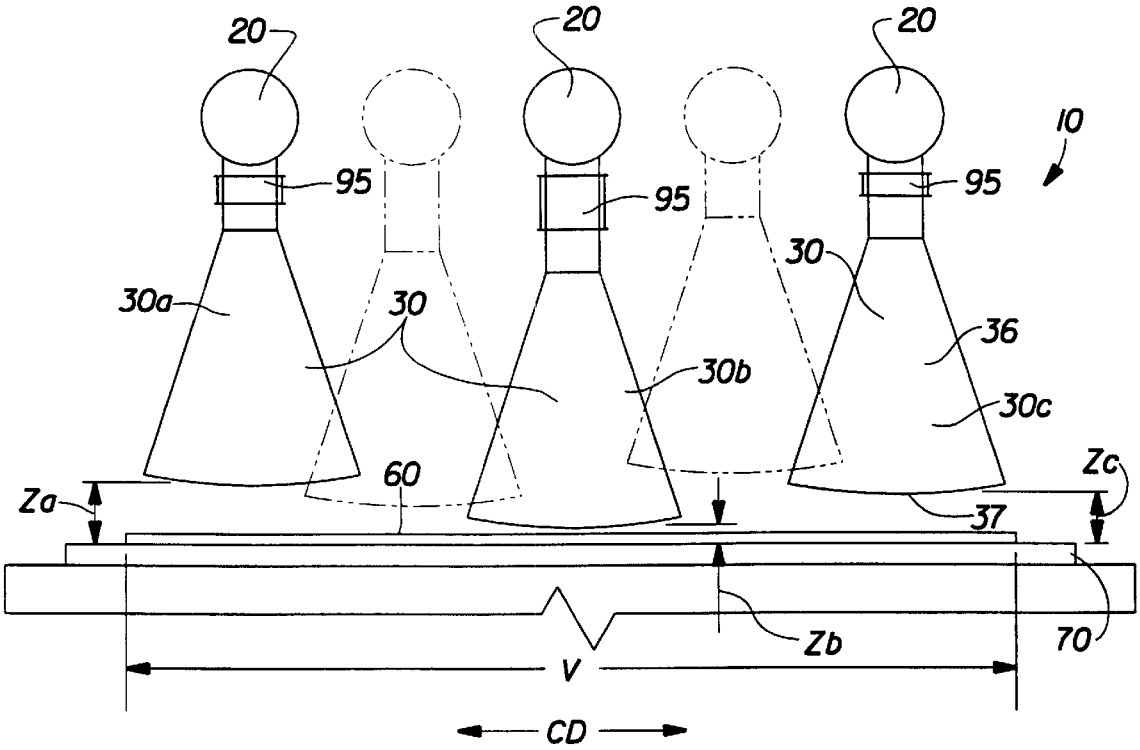
FIG. 15 is a schematic side elevational view of an embodiment of the process, showing a plurality of pulse generators spaced apart from one another in the cross-machine direction.
Figure 16:
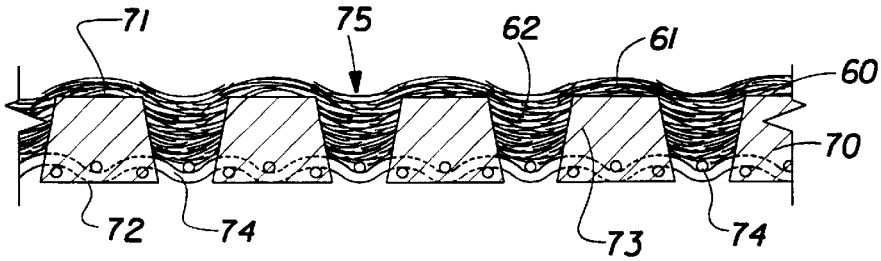
FIG. 16 is a partial and schematic side elevational view of an embodiment of a fluid-permeable support for a paper web, comprising a substantially continuous framework joined to a reinforcing structure, the support having a fibrous material to be dewatered or dried thereon.
Figure 17:
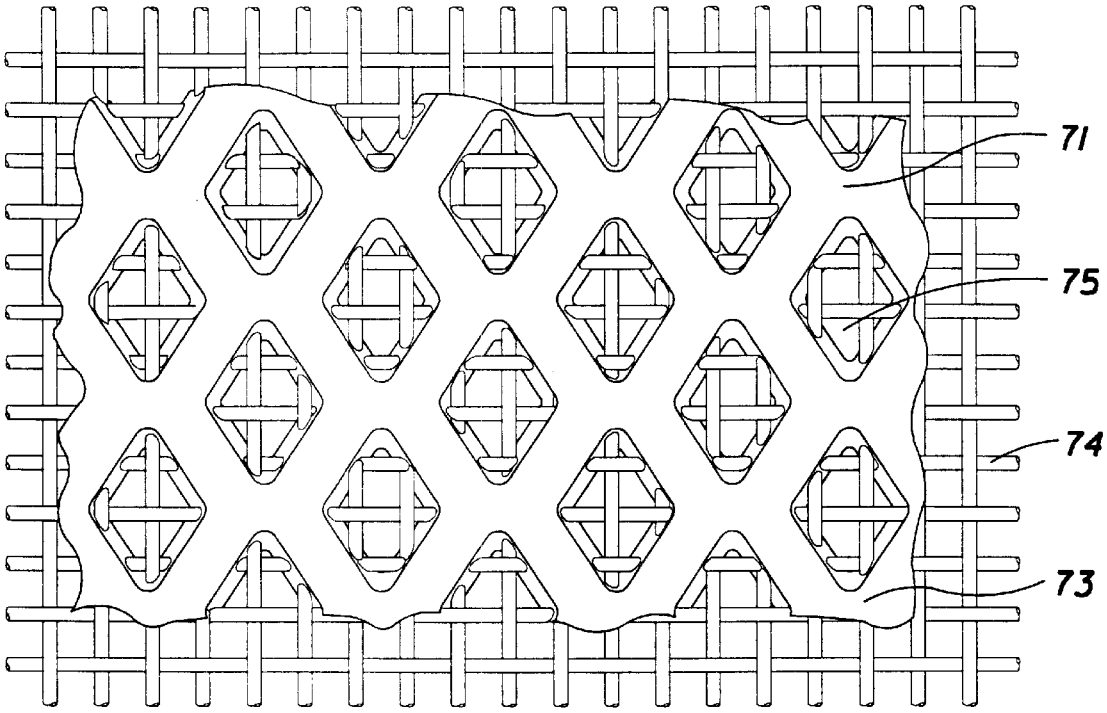
FIG. 17 is a partial schematic plan view of the support shown in FIG. 16 (the material to be dewatered or dried is not shown for clarity).
Figure 18:
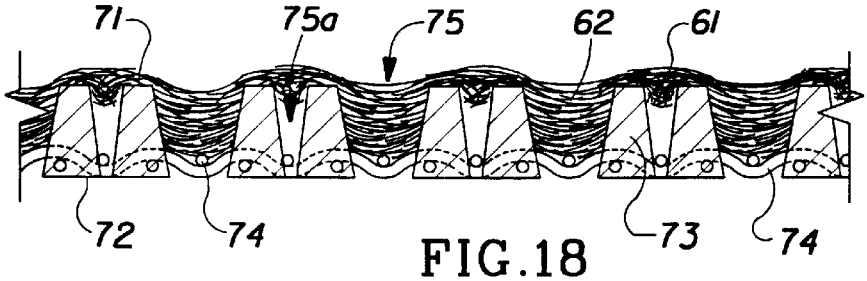
FIG. 18 is a partial schematic side elevational view of an embodiment of the fluid-permeable support comprising a plurality of discrete protuberances joined to a reinforcing structure, the support having a fibrous material to be dewatered or dried thereon.
Figure 19:
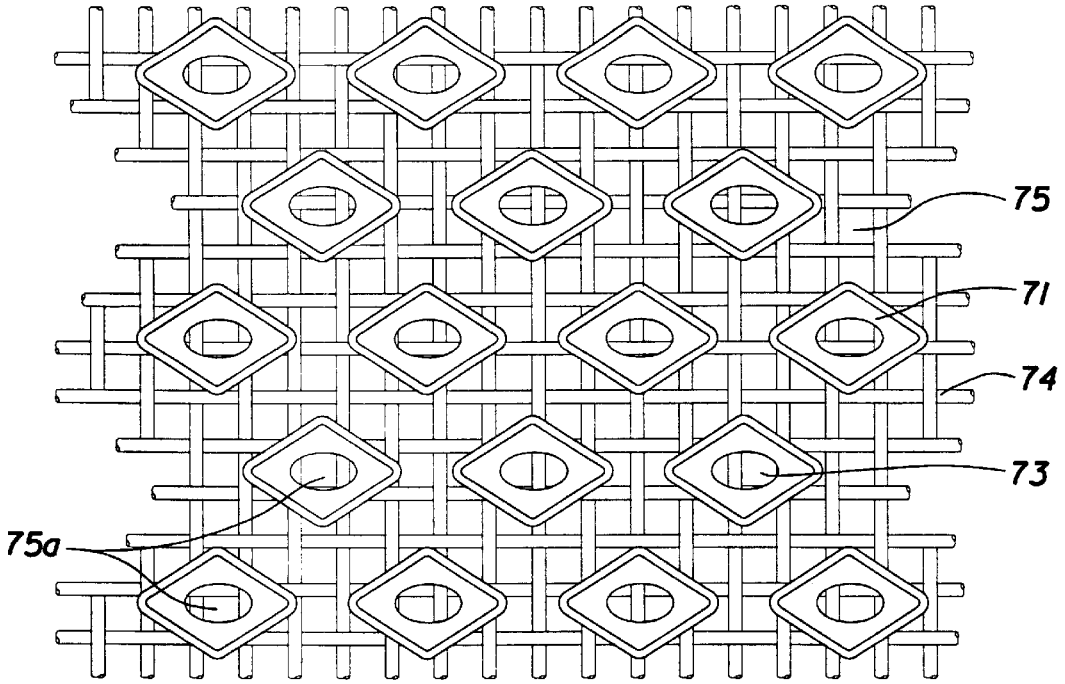
FIG. 19 is a partial schematic plan view of the support shown in FIG. 18 (the fibrous material to be dewatered or dried is not shown for clarity).

FIG. 15 schematically shows an embodiment of the process of the present invention, in which a plurality of the gas distributing systems 30 (30*a*, 30*b*, and 30*c*) is used across the width of the material 60. This arrangement allows a greater flexibility in controlling the conditions of the material to be dewatered or dried-dewatering process across the width of the material 60, and thus in controlling relative humidity and/or dewatering rates of the differential (presumably, in the cross-machine direction) portions of the material 60. For example, such arrangement allows one to control the impingement distance Z individually for differential portions of the material 60. In FIG. 15, the gas-distributing system 30*a* has an impingement distance Za, the gas-distributing system 30*b* has an impingement distance Zb, and the gas-distributing system 30*c* has an impingement distance Zc. Each of the impingement distances Za, Zb, and Zc may be individually adjustable, independently from one another. A means 95 for controlling the impingement distance Z can be provided. While FIG. 15 shows three pulse generators 20, each having its own gas-distributing system 30, it should be understood that in other embodiments, a single pulse generator 20 can have a plurality of gas-distributing systems 30, each having means for the individually-adjustable impingement distance Z.

Control of the residence time is another important component of the process of the present invention. As used herein, the "residence time" is the time during which a single unit of the material 60 being dewatered or dried is subjected to the oscillatory flow-reversing gas field. The residence time influences total water removal, product degradation, and uniformity of water-removal rates from the material 60. The desired residence time may be dictated by the nature and geometry of the material 60 (for example, paper web versus granular material); water retention characteristics of the material 60 (for example, free water versus bound water); and the thermal sensitivity of the material 60, i. e., the ability of the material 60 to tolerate high temperatures. As a result, residence times may greatly vary, depending on the material 60.

The discharge outlets of the gas-distributing system may have a variety of shapes, including, but not limited, to: a round shape, generally rectangular shape, a slot-like shape, etc., as explained above. In the instance of the discharge outlet having a substantially circular or curved configuration, if each of the discharge outlets has the equivalent diameter "D"; the oscillatory flow reversing gas has the frequency "F"; and the material to be dewatered or dried is supported by the support traveling in the machine direction at a speed "S" ; then the residence time "T" under the discharge outlet can be calculated as follows: $T \geqq D/S$. In the instance of the discharge outlet having a substantially rectangular configuration, the equation will be $T>m/S$, where "m" is a machine-directional dimension of the open area of the discharge outlet (FIG. 21).

The velocity, and in some embodiments the temperature, cyclically vary with time at a characteristic frequency. In order to achieve the full benefits of this invention and ensure drying uniformity if such desired, in some embodiments it may be important to closely match the residence time of the material 60 to the frequency of the oscillatory flow impingement gas. It is believed to be beneficial to have the material 60 exposed to at least one complete cycle of the oscillatory flow reversing flow. This condition can be described by the following equation: $RT<1/F$.

Alternatively or additionally, a plurality of pulse generators may be used disposed in the machine direction along the path of the material being dewatered. These may operate either in or out of phase with one another. Multiple exposures of the moving material to the oscillatory flow reversing flow field will dampen out local moisture gradients and achieve maximum dewatering efficiency.

In the embodiments of the process of the present invention, comprising two or more pulse generators 20, a pair of pulse generators 20 may advantageously operate in a tandem configuration, in close proximity to each other. This arrangement (not illustrated) may result in a 180°-phase lag between the "firing" of the tandem pulse generators 20, which could produce an additional benefit by reducing noise emissions. This arrangement can also produce higher dynamic pressure levels within the pulse combustors, which, in turn, cause a greater cyclical velocity Vc of the oscillatory flow-reversing impingement gases exiting the discharge outlets 39 of the resonance system 30. The greater cyclical velocity Vc enhances dewatering efficiency of the process.

Figure 6:
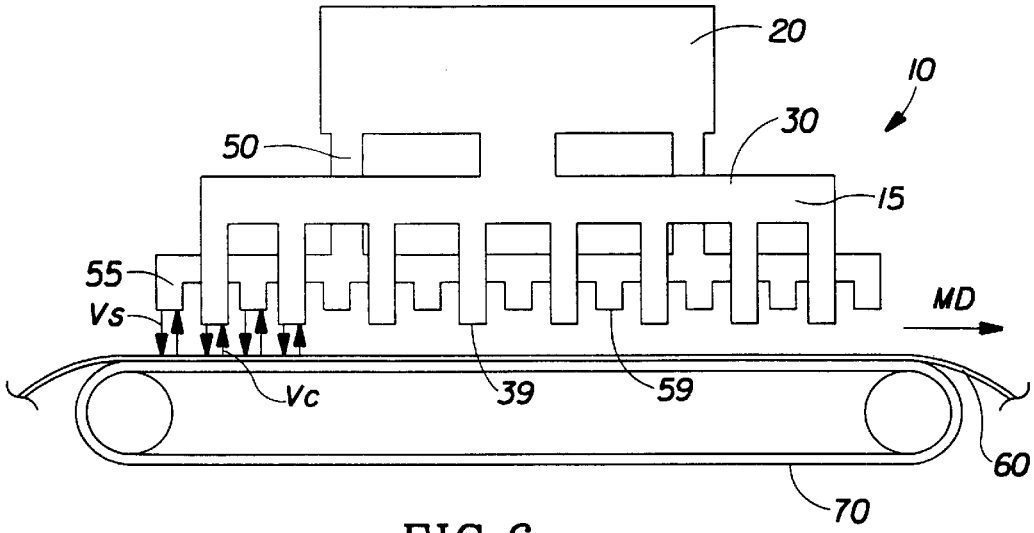
FIG. 6 is a schematic and simplified side elevational view of an embodiment of the apparatus and the process of the present invention, showing a pulse generator sequentially impinging oscillatory flow-reversing impingement air or gas alternating with steady-flow impingement air or gas onto the supported by an endless belt or band traveling in a machine direction.
Figure 7:
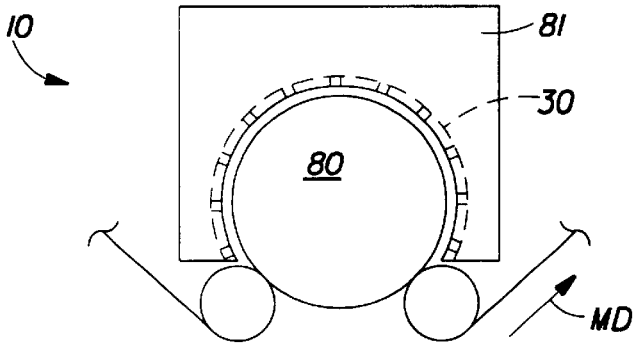
FIG. 7 is a schematic partial view of the apparatus of the present invention, used in a process of removing water from a web material, the apparatus comprising a dryer hood of a drying cylinder, the web material being supported by the dryer cylinder.
Figure 7A:
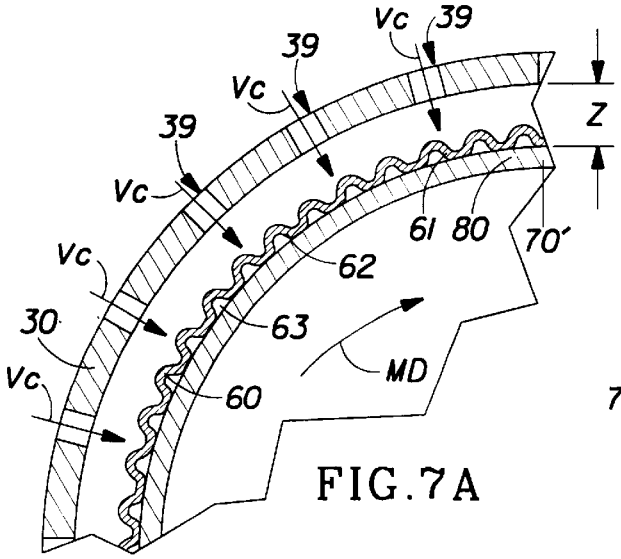
FIG. 7A is a partial schematic cross-sectional view of the apparatus of the present invention, including support comprising a drying cylinder carrying the web material thereon and a pulse generator's gas-distributing system comprising a plurality of the discharge outlets.
Figure 7B:
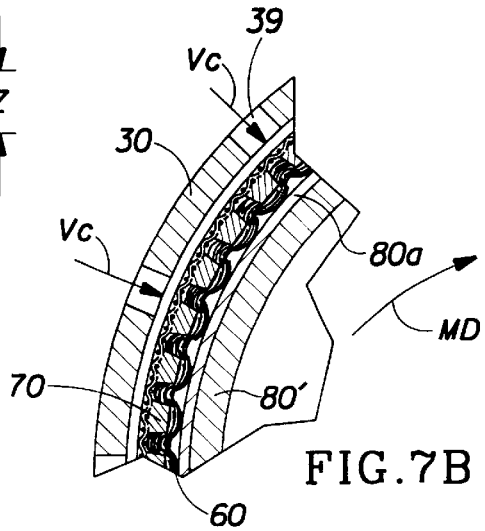
FIG. 7B is a view similar to that shown in FIG. 7A, and showing the support comprising a fluid-permeable belt, the web material being impressed between the support and the surface of a drying cylinder, the oscillatory flow-reversing gas being applied to the web material through the support.
Figure 8:
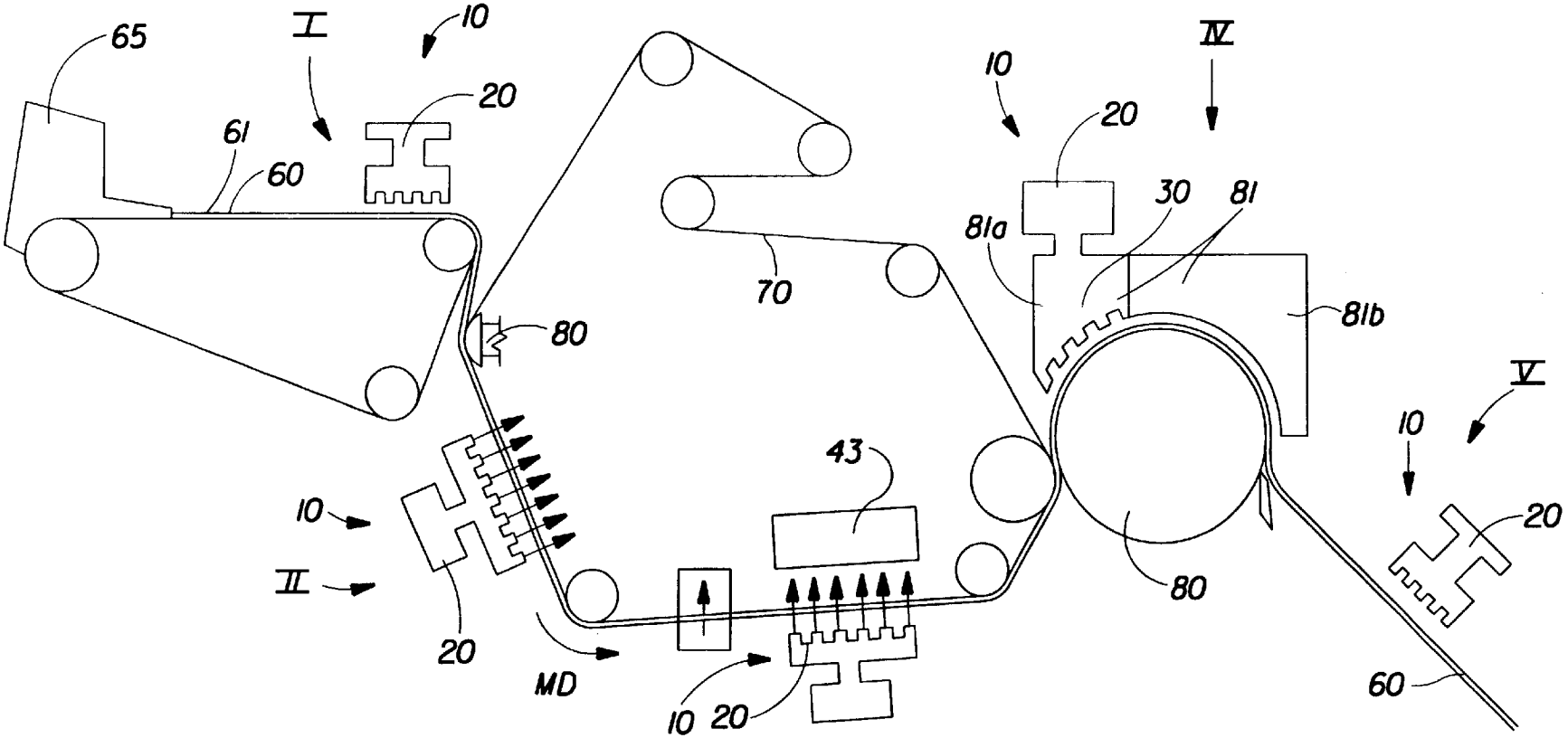
FIG. 8 is a schematic representation of an embodiment of a continuous papermaking process, according to the present invention, illustrating some of the possible locations of the apparatus of the present invention relative to the overall papermaking process.

According to the present invention, the oscillatory field of the flow-reversing impingement gas may beneficially be used in combination with a steady-flow impingement gas. One such embodiment of the process comprises sequentially-alternating application of the oscillatory flow-reversing gas and the steady-flow gas. FIG. 6 schematically shows a principal arrangement of such an embodiment of the process. In FIG. 6, the gas-distributing system 30 delivers the oscillatory flow-reversing impingement gas through the tubes 15 having the discharge outlets 39; and a steady-flow gas-distributing system 55 delivers steady-flow impingement gas through the tubes 55 having discharge outlets 59. In FIG. 6, directional arrows "Vs" schematically indicate the velocity (or movement) of the steady-flow gases, and directional arrows "Vc" schematically indicate the cyclical velocity (or oscillatory movement) of the oscillatory flow-reversing gases. As the material 60 travels in the machine direction MD, the oscillatory flow-reversing gas and the steady-flow (non-oscillatory) gas sequentially impinge upon the material 60. This order of treatment can be repeated many times along the machine direction, as the material 60 travels in the machine direction. It is believed that the oscillatory flow field "scrubs" the residual water vapor, comprising a boundary layer, above the drying surface of the material 60, thereby facilitating removal of the water therefrom by the steady-flow impingement gas. This combination increases the drying performance of the steady-flow impingement drying system. It should be appreciated that in the process comprising application of the combination of the steady-flow gas and the oscillatory flow-reversing gas, the angled application of the impingement gas is contemplated in the present invention. In this instance, one of or both the oscillatory gas and the steady-flow gas can comprise jet streams having the "angled" position relative to the support 70, as has been explained in greater detail above.

In FIG. 6, a means for generating oscillatory and steady-flow impingement gases are schematically shown as comprising the same pulse generator 20. In this instance, control of the temperature of the steady-flow gas may be necessary to prevent thermal damage to the material 60 or to control the water-removal rates. It is to be understood, however, that a separate steady-flow generator (or generators) may be provided, which is (are) independent of the pulse generator 20. Alternatively, the steady flow source may be provided by cooling the outside surface of the pulse generator and directing the resulting gas stream to material 60. These arrangement are within the scope of knowledge of one skilled in the art, and therefore is not illustrated herein.

Injection of diluents during the combustion cycle of the pulse combustor, either continuously, or periodically to match the operating frequency of the combustor, is contemplated in the present invention. As used herein, the "diluents" comprise liquid or gaseous substances that may be added into the combustion chamber 13 of the pulse combustor 21 to produce an additional gaseous mass thereby increasing the mean velocity V of the combustion gases. The addition of purge gas can also be used to increase the mean velocity V of the oscillatory flow field produced by the pulse combustor 21. The higher mean velocity V will, in turn, alter the flow-reversal characteristics of the oscillatory flow field over a wide range. This is advantageous in providing additional control over the oscillatory-flow field's characteristics, separately from controlling the same by the geometry of the gas-distributing system 30, characteristics of the aerodynamic air valve 11*a*, and thermal firing rate of the pulse combustor 21. An increase of the mean velocity V also facilitates convective mass transfer which in turn enhances water-removal efficiency of the process.

Combustion by-products produced in a Helmholtz-type pulse combustor operating on natural gases typically contains about 10–15% water vapor. The water exists as superheated steam vapor due to the high operational temperature of the pulse combustor and the resultant combustion gas. The injection of additional water or steam into the pulse combustor 21 is contemplated in the process and the apparatus 10 of the present invention. This injection may produce additional superheated steam, in situ, without the need for ancillary steam-generating equipment. The addition of superheated steam to the oscillatory flow-reversing field of impingement gas may be effective in increasing the resulting heat flux delivered unto the paper material 60.

The pulse combustor 21 of the present invention may also include means for forcing air into the combustion chamber 13, to increase an intensity of the combustion. In this instance, first, a higher flow resistance increases the dynamic pressure amplitude in the Helmholtz resonator. Second, the use of the pressurized air tends to supercharge the combustor 21 to higher firing rates than those obtainable at atmospheric aspirating conditions. The use of an air plenum, thrust augmenter, or supercharger are contemplated in the present invention.

It is believed that the superior water-removal rates of the process of the present invention may are attributed to the oscillatory flow-reversing character of the impingement gas. Normally, during water-removing processes of the prior art, the water evaporating from the material to be dewatered or dried forms a boundary layer in a region adjacent to the exposed surface of the material to be dewatered or dried. It is believed that this boundary layer tends to resist to the penetration of the material to be dewatered or dried by impingement gasses. The flow-reversing character of the oscillatory impingement air or gas of the present invention produces a disturbing "scrubbing" effect on the boundary layer of evaporating water, which results in thinning (or "dilution") of the boundary layer. It is believed that this thinning of the boundary layer reduces resistance of the boundary layer to the oscillatory air or gas, and thus allows subsequent cycles of the oscillatory air or gas to penetrate deep into the material to be dewatered or dried. This results in more uniform heating of the material to be dewatered or dried, irrespective of differential density of the material to be dewatered or dried.

Furthermore, the oscillatory field of the flow-reversing gas produced by the Helmholtz-type pulse generator 20 results in high heat flux due to the high convective heat-transfer coefficients of the flow-reversing characteristics of the oscillatory gas. It has been found that not only does the oscillatory flow-reversing field result in high dewatering rates, but rather surprisingly also results in relatively low temperatures of the material 60, compared to the steady-flow impingement of the prior art, under the similar conditions.

Not being bound by theory, the applicant believes that the oscillatory flow-reversing nature of the impingement gas produces a very high evaporating cooling effect, due to the mixing of surrounding bulk air onto the drying surface of the material 60. This instantaneously cools the surface of the material 60 and facilitates removal of the boundary layer of the evaporated water. The combination of cyclical application of heat alternating with cyclical surface cooling and "scrubbing" of the boundary layer dramatically enhances the water-removal rates of the process of the present invention, relative to the steady-flow impingement of the prior art, under comparable conditions. Due to this tendency of the material 60 to maintain low surface temperature relative to the temperature of the oscillatory flow-reversing gas acting upon the surface of the material 60, the temperature of the oscillatory flow-reversing gas can be greatly increased without creating adverse effect on the material 60. Such high temperatures substantially increase water-removal rates, compared to the steady-flow impingement. For example, in the context of papermaking, a maximum steady-flow impingement temperatures of about 1000–1200° F. is typically used in commercial high-speed Yankee dryer hoods. (In modern high-speed industrial processes, the temperature of the web is not greater than about 250–300° F., due to a very short residence time.) The oscillatory flow-reversing gas, in accordance with the present invention, allows one to use the impingement temperatures in excess of 2000° F. without damaging a temperature-sensitive material 60, such as, for example, a paper web.

As has been explained above, it is believed that the oscillatory flow-reversing gases are impinged upon the material 60 on the positive cycles and pulled away from the material 60 on the negative cycles thereby carrying away moisture contained in the material 60. The moisture pulled away from the material 60 typically accumulates in the boundary layer adjacent to the surface of the material 60. Therefore, it may be desirable to reduce, or even prevent, build-up of humidity in the boundary layer and the area adjacent thereto. In accordance with the present invention, therefore, the apparatus 10 may have an auxiliary means 40 for removing moisture from the impingement region including the boundary layer, and an area surrounding the impingement region. In FIG. 1, such auxiliary means 40 shown as comprising slots 42 in fluid communication with an outside area having the atmospheric pressure. Alternatively or additionally, the auxiliary means 40 may comprise a vacuum source 41. In the latter instance, the vacuum slots 42 may extend from the impingement region and/or an area adjacent to the impingement region to the vacuum source 41, thereby providing fluid communication therebetween.

In one embodiment of the process of the present invention, the apparatus 10 of the present invention may be beneficially used in combination with a vacuum apparatus, such as, for example, a vacuum pick-up shoe 80 or a vacuum box 43 (FIG. 8), in which instance the support is preferably fluid-permeable. The vacuum apparatus, for example a vacuum box 43, is juxtaposed with the backside surface of the support, preferably in the area corresponding to the impingement region. The vacuum apparatus applies a vacuum pressure to the material being dewatered or dried, through the fluid-permeable support. In this instance, the oscillatory flow-reversing gas created by the pulse generator 10 and the pressure created by the vacuum box 43 can beneficially work in cooperation, thereby significantly increasing the efficiency of the combined dewatering process, relative to each of those individual processes. In such an embodiment, the thickness of the material 60 should not create excessive pressure drop such that the water vapor cannot be pulled through the material. This depends, of course, on the structure and porosity of the material 60.

The process of the present invention can be used in combination with application of ultrasonic, infrared and microwave energy. The application of the ultrasonic energy is described in a commonly-assigned patent application Ser. No. 09/065,655, filed on Apr. 23, 1998, in the names of Trokhan and Senapati, which application is incorporated by reference herein.

What is claimed is:

1. A process for removing water from a material, which process comprises the following steps:

(a) providing a material having a moisture content from about 1% to about 99%;

(b) providing an oscillatory flow-reversing gaseous media having a predetermined frequency;

(c) providing a gas-distributing system designed to deliver the oscillatory flow-reversing gaseous media onto a pre-determined portion of the material and comprising at least one discharge outlet; and (d) impinging the oscillatory flow-reversing gas onto the material through the at least one discharge outlet, thereby removing moisture from the material.

2. The process according to claim 1, wherein in the step of impinging the oscillatory flow-reversing gaseous media onto the material, the oscillatory flow-reversing gaseous media is impinged onto said material such as to provide a substantially even distribution of the oscillatory flow-reversing gaseous media throughout said pre-determined portion of the material.

3. The process according to claim 1, wherein in the step of impinging the oscillatory flow-reversing gaseous media onto the material, the oscillatory flow-reversing impingement gaseous media has oscillating sequence of positive cycles and negative cycles at a frequency from about 15 Hz to about 3,000 Hz, the positive cycles having a positive amplitude and the negative cycles having a negative amplitude less than the positive amplitude, the impingement gaseous media further having a cyclical velocity comprising a positive velocity directed in a positive direction towards the material during the positive cycles and a negative velocity directed in a negative direction opposite to the positive direction during the negative cycles, the positive velocity being greater than the negative velocity.

4. The process according to claim 1, wherein in the step of impinging the oscillatory flow-reversing gaseous media onto the material, a temperature of the oscillatory flow-reversing impingement gaseous media cyclically vary at a pre-determined frequency.

5. The process according to claim 1, wherein in the step of impinging the oscillatory flow-reversing gaseous media onto the material, a temperature of the oscillatory flow-reversing impingement gaseous media is from ambient to about 2500° F.

6. The process according to claim 3, wherein the positive direction of at least some of the streams of the flow-reversing impingement gaseous media and a surface of the material form acute angles therebetween.

7. The process according to claim 3, wherein the oscillatory flow-reversing gaseous media at least partially penetrates the material during the positive cycles and pulls the water from the material and an area adjacent thereto during the negative cycles.

8. The process according to claim 1, wherein in the step of providing a material, said material is selected from the group consisting of fibrous webs, textiles, plastics, non-woven webs, building materials, or any combination thereof.

9. The process according to claim 1, wherein in the step of providing a material, said material is selected from the group consisting of an agricultural product, a food product, a pharmaceutical product, a biotechnology product, or any combination thereof.

10. The process according to claim 9, wherein the material is selected from the group consisting of grains, coffee beans, cocoa beans, legumes, seeds, vitamins, flavors, potato chips, candies, or any combination thereof.

11. A process for removing water from a material to be dewatered or dried, which process comprises the following steps:

(a) providing a material having a moisture content from about 1% to about 99%;

(b) providing a support having a machine direction and a cross-machine direction perpendicular to the machine direction, the support being structured and configured to move in the machine direction;

(c) disposing the material on the support;

(d) providing a pulse generator designed to produce and discharge oscillatory flow-reversing gaseous media having a pre-determined frequency from about 15 Hz to about 3,000 Hz;

(e) providing a gaseous media-distributing system in fluid communication with the pulse generator and terminating with at least one discharge outlet juxtaposed with the support at a pre-determined impingement distance Z therefrom;

(f) moving the support having the material thereon in the machine direction at a transport velocity; and (g) operating the pulse generator and impinging the oscillatory flow-reversing gaseous media through the at least one discharge outlet onto the material, thereby removing moisture from the material.

12. The process according to claim 11, wherein in the step of providing a support, the support comprises an endless belt or band.

13. The process according to claim 11, further comprising a step of removing the moisture from an impingement region formed between the at least one discharge outlet and the support.

14. The process according to claim 13, wherein the step of removing the moisture from the impingement region comprises removing the moisture with a vacuum apparatus.

15. The process according to claim 11, further comprising the steps of providing a non-oscillatory impingement gaseous media and impinging the non-oscillatory gaseous media onto the material.

16. The process according to claim 15, wherein the oscillatory flow-reversing gaseous media and the non-oscillatory gaseous media are sequentially impinged onto the material.

17. The process according to claim 11, further comprising a step of adjusting at least one of the frequency of the oscillatory flow-reversing gaseous media and the transport velocity, such as to expose a pre-determined portion of the material to at least one complete cycle of the flow-reversing gaseous media.

18. A water-removing apparatus for a process of dewatering or drying a material, the apparatus having a machine direction and a cross-machine direction perpendicular to the machine direction, the apparatus comprising:

a support structured and configured to receive the material to be dewatered or dried and to carry said material in the machine direction;

at least one pulse generator for producing oscillatory flow-reversing air or gaseous media having a pre-determined frequency in the range of from 15 Hz to 3000 Hz; and at least one gaseous media-distributing system in fluid communication with the at least one pulse generator for delivering the oscillatory flow-reversing air or gaseous media to a pre-determined portion of the web, the gaseous media-distributing system terminating with at least one discharge outlet juxtaposed with the support such that the support and the at least one discharge outlet form an impingement region therebetween defined by an impingement distance.

19. The apparatus according to claim 18, wherein the impingement distance is controllable.

20. The apparatus according to claim 18, wherein the at least one discharge outlet comprises a plurality of discharge outlets distributed in a predetermined pattern defining an impingement area of the material to be dewatered or dried.

21. The apparatus according to claim 18, wherein the at least one pulse generator comprises a pulse combustor generating oscillatory flow-reversing gaseous media having frequency of from about 15 Hz to about 500 Hz.

22. The apparatus according to claim 18, wherein the at least one discharge outlet emits a stream of the oscillatory flow-reversing gaseous media having, when exiting the at least one discharge outlet, a cyclical temperature from ambient to about 2500° F., and a cyclical velocity from about 1,000 ft/min to about 50,000 ft/min.

23. The apparatus according to claim 20, wherein at least some of the streams of the oscillatory impingement gaseous media and a general surface of the support form therebetween an angle ranging from zero to ninety degrees.

24. The apparatus according to claim 18, wherein the at least one pulse generator comprises an infrasonic device generating oscillatory flow-reversing air having frequency from about 15 Hz to about 100 Hz.

25. The apparatus according to claim 18, wherein the at least one pulse generator comprises a device selected from the group consisting of solenoid valves, fluidic valves, rotary valves, butterfly valves, vibrating mechanical elements, rotating lobes, pizeo electric elements, or any combination thereof.

26. The apparatus according to claim 25, wherein the at least one pulse generator comprises a rotary valve pulse generator generating oscillatory flow-reversing air having frequency from about 15 Hz to about 250 Hz.

27. The apparatus according to claim 18, wherein the support comprises an endless belt or band continuously traveling in the machine direction.

28. The apparatus according to claim 18, wherein the support comprises a vibrating support.

29. The apparatus according to claim 18, further comprising an auxiliary means for removing the moisture from the impingement region formed between the at least one discharge outlet and the support.

30. The apparatus according to claim 29, wherein the auxiliary means comprises a vacuum source and at least one vacuum slot extending from the vacuum source to the impingement region, thereby providing a fluid communication between the impingement region and the vacuum source.

31. The apparatus according to claim 18, further comprising a means for generating a substantially steady-flow gaseous media and impinging the steady-flow gaseous media onto the material.

32. The apparatus according to claim 18, further comprising a vacuum apparatus juxtaposed with the backside surface of the support for removing the moisture from the material through the support, wherein said support is fluid-permeable.

* * * * *